US006452326B1

(12) United States Patent
Ge et al.

(10) Patent No.: US 6,452,326 B1
(45) **Date of Patent: *Sep. 17, 2002**

(54) COLD CATHODE FLUORESCENT LAMP AND DISPLAY

(75) Inventors: Xiaoqin Ge, Hang Zhou (CN); Shichao Ge, San Jose, CA (US); Victor Lam, Saratoga, CA (US); Yiping Ge, San Jose, CA (US)

(73) Assignee: GL Displays, Inc., Saratoga, CA (US)

( * ) Notice: Subject to any disclaimer, the term of this patent is extended or adjusted under 35 U.S.C. 154(b) by 54 days.

This patent is subject to a terminal disclaimer.

(21) Appl. No.: 09/667,456

(22) Filed: Sep. 22, 2000

Related U.S. Application Data

(63) Continuation of application No. 09/073,738, filed on May 6, 1998, now Pat. No. 6,310,436, which is a continuation-in-part of application No. 08/532,077, filed on Sep. 22, 1995, now Pat. No. 5,834,889.

(51) Int. Cl.[7] ..... H01J 1/62
(52) U.S. Cl. ..... 313/493; 313/495; 313/25
(58) Field of Search ..... 313/493, 25, 113, 313/312, 317, 495, 611, 573, 602, 27, 28, 30, 33, 47, 1, 318.01, 318.12, 318.08

(56) References Cited

U.S. PATENT DOCUMENTS

| | | | |
|---|---|---|---|
| 4,029,984 | A | 6/1977 | Endiz |
| 4,625,152 | A | 11/1986 | Nakai |
| 4,767,193 | A | 8/1988 | Ota et al. |

(List continued on next page.)

FOREIGN PATENT DOCUMENTS

| | | |
|---|---|---|
| CN | 1123945 | 6/1996 |
| CN | 95116709 | 3/1997 |
| EP | 0331660 | 9/1989 |
| JP | 62-157657 | 7/1987 |
| JP | 01315787 | 12/1989 |
| WO | WO95/22835 | 8/1995 |

OTHER PUBLICATIONS

"28.5 Large–Area Color Display 'Skypix'," Yoshiyasu Sakaguchi et al., *SID 91 Digest*, 1991, pp. 557–579.

"S11–3 Study to Improve the Flood–Beam CRT for Giant Screen Display," M. Morikawa et al., *Japan Display '92*, 1992, pp. 385,388.

"8.2: A High–Resolution High–Brightness Color Video Display for Outdoor Use," N. Shiramatsu et al., *SID '89 Digest*, 1989, pp. 102–105.

*Primary Examiner*—Ashok Patel
(74) *Attorney, Agent, or Firm*—James S. Hsue; Skjerven Morrill LLP

(57) ABSTRACT

A light transmitting container is used to house a cold cathode fluorescent lamp (CCFL) to reduce heat loss and to increase the luminous efficiency of the lamp. An electrical connector configuration is connected to an electrode of the lamp and adapted to be electrically and mechanically connected to a conventional electrical socket. A driver circuit in the container converts 50 or 60 Hz power to the high frequency power suitable for operating the CCFL. At least one of the electrodes of the CCFL is outside of the container to facilitate heat dissipation. A two-dimensional array of CCFLs may be held by a module housing to form a display for displaying still or moving images and characters. The above-described CCFL configurations may also be used for displaying traffic information. A monochromic, multi-color and full-color cold cathode fluorescent display (CFD), comprises: some shaped white or multi-color or red, green, blue three primary color CCFLs, reflector, base plate, temperature control means, luminance and contrast enhancement face plate, shades and its driving electronics. CFD is a large screen display device which has high luminance, high efficiency, long lifetime, high contrast and excellent color. CFD can be used for applications both of outdoor and indoor even at direct sunlight, to display character, graphic and video image.

1 Claim, 26 Drawing Sheets

U.S. PATENT DOCUMENTS

| | | | |
|---|---|---|---|
| 4,839,564 | A | 6/1989 | Ide et al. |
| 4,934,768 | A | 6/1990 | Blaisdell |
| 4,937,487 | A | 6/1990 | Blaisdell et al. |
| 5,093,698 | A | 3/1992 | Egusa |
| D334,242 | S | 3/1993 | Imamura et al. |
| 5,191,259 | A | 3/1993 | Hayashi et al. |
| D334,990 | S | 4/1993 | Sekiguchi et al. |
| 5,216,324 | A | 6/1993 | Curtin |
| 5,220,249 | A | 6/1993 | Tsukada |
| 5,317,169 | A | 5/1994 | Nakano et al. |
| 5,387,837 | A | 2/1995 | Roelevink et al. |
| 5,424,560 | A | 6/1995 | Norman et al. |
| 5,457,312 | A | 10/1995 | Mansour |
| 5,457,565 | A | 10/1995 | Namiki et al. |
| 5,502,626 | A | 3/1996 | Armstrong et al. |
| 5,514,934 | A | 5/1996 | Matsumoto et al. |
| 5,668,443 | A | 9/1997 | Kawaguchi et al. |
| 6,211,612 | B1 * | 4/2001 | Ge ..... 313/493 |

* cited by examiner

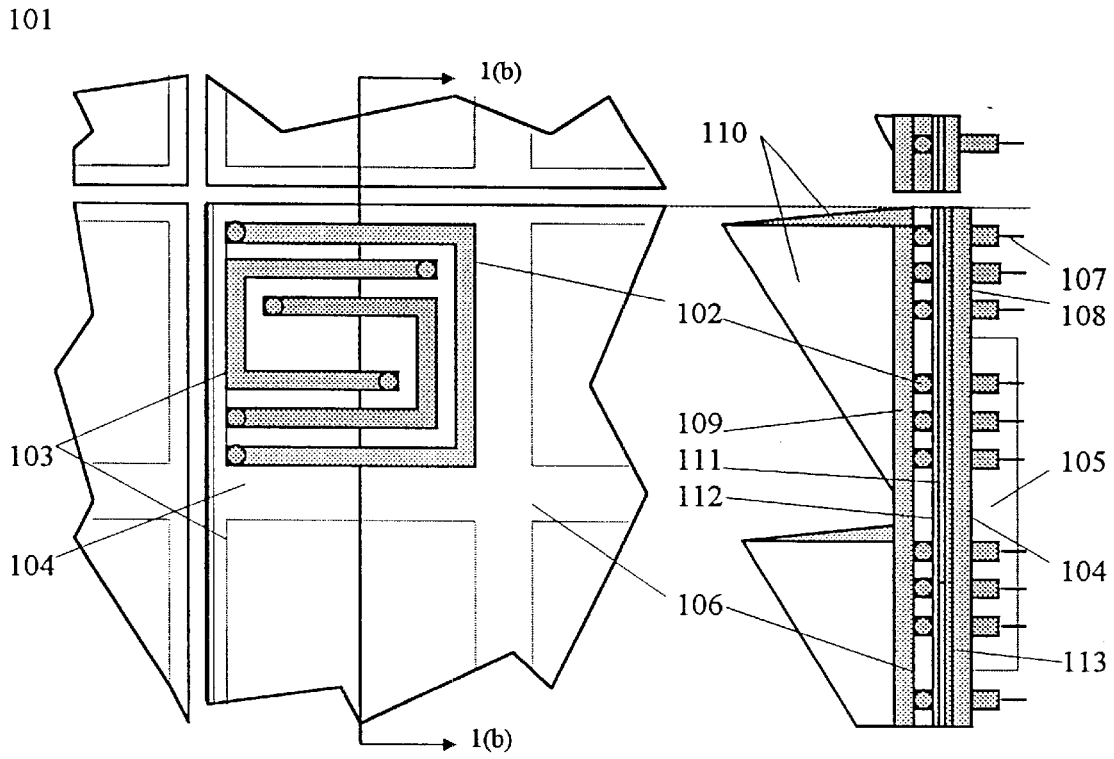
Fig. 1 ( a ) Fig. 1 ( b )
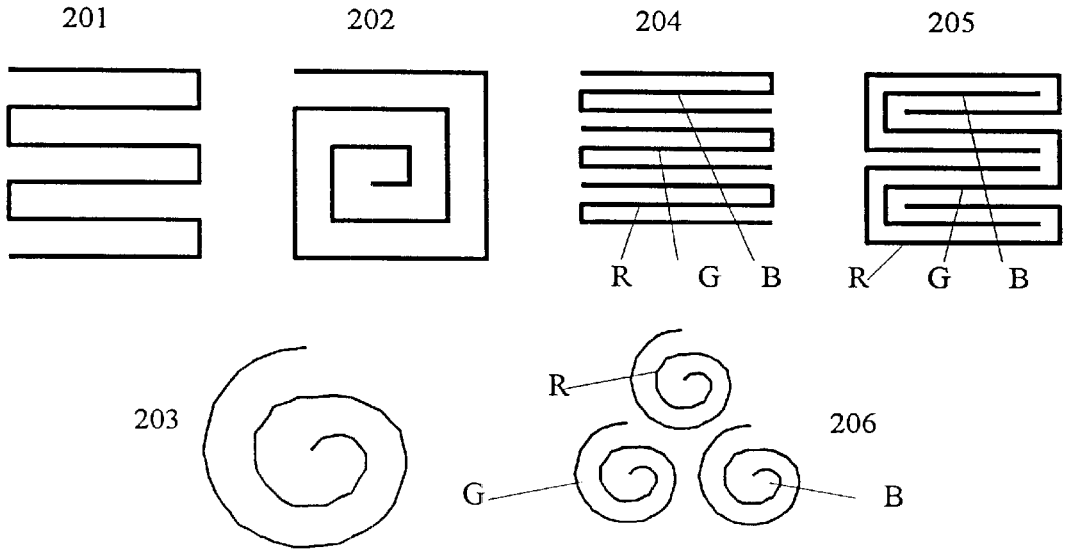
Fig. 2

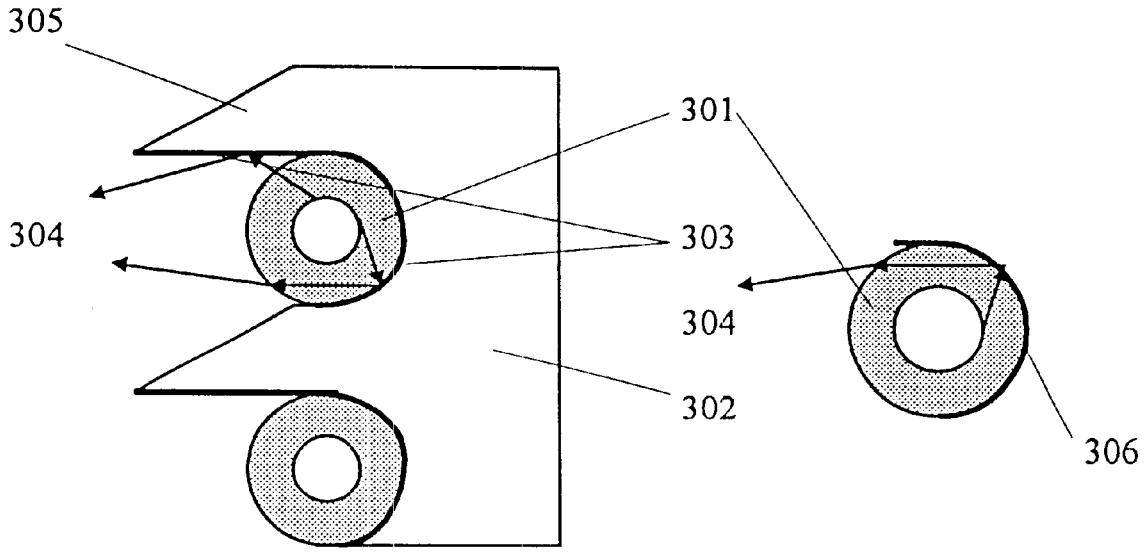
Fig. 3 ( a ) Fig. 3 ( b )
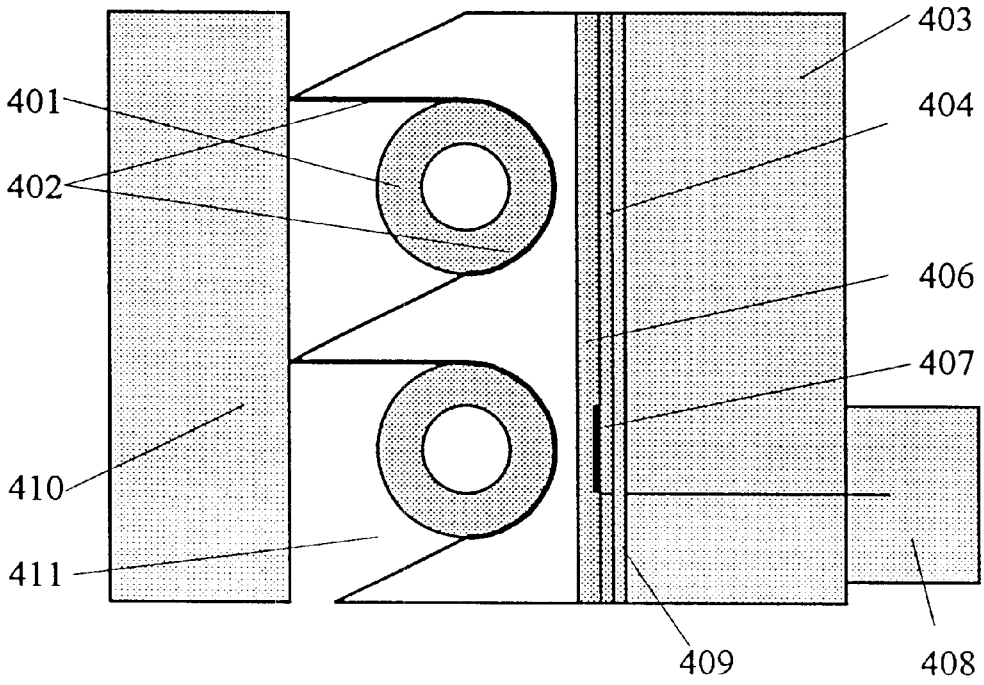
Fig. 4

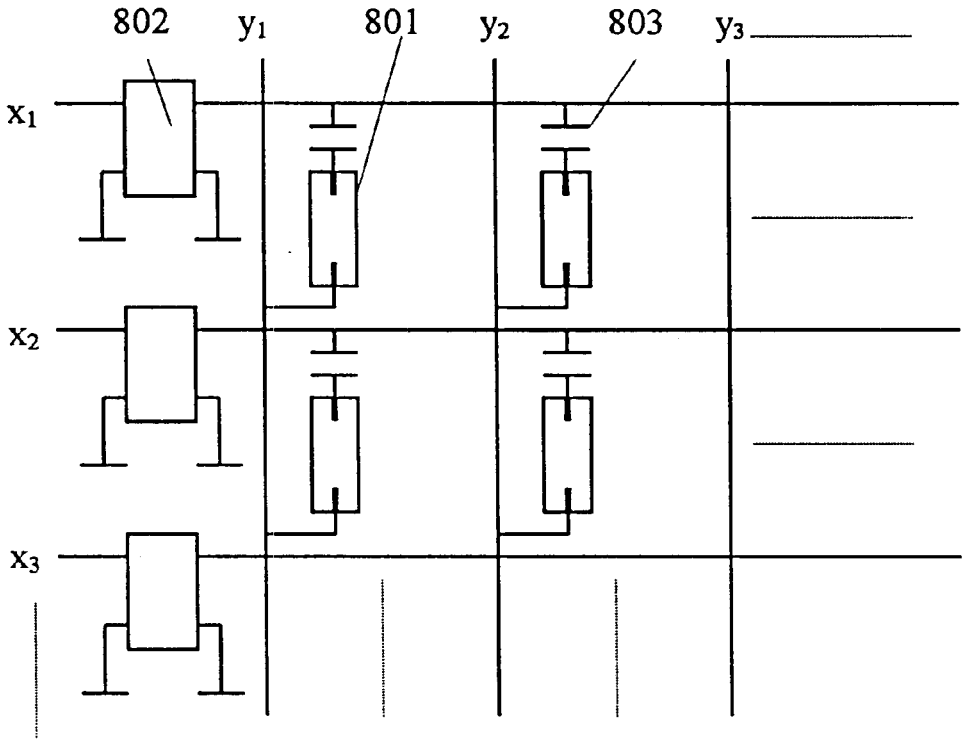
Fig. 8 ( a )
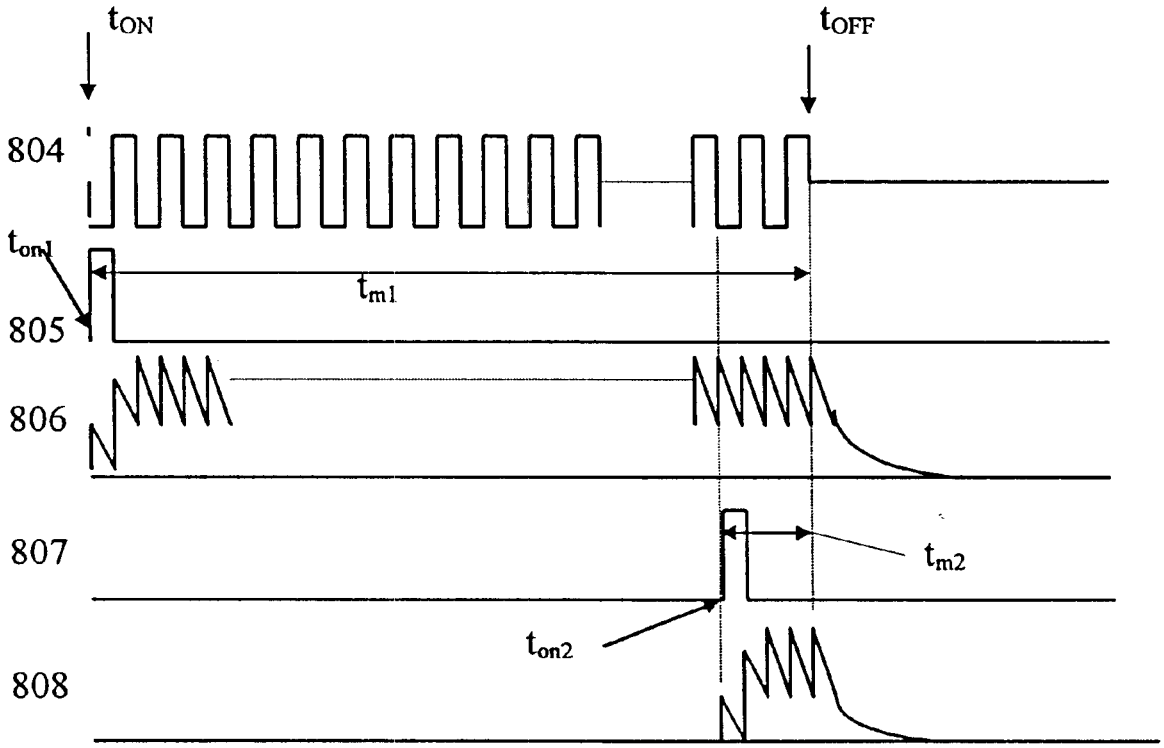
Fig. 8 ( b )

COLD CATHODE FLUORESCENT LAMP AND DISPLAY

CROSS REFERENCE TO RELATED APPLICATION

This is a continuation of U.S. patent application Ser. No. 09/073,738, filed May 6, 1998, now U.S. Pat. No. 6,310,436, which is a continuation-in-part of U.S. patent application Ser. No. 08/532,077, filed Sep. 22, 1995, now U.S. Pat. No. 5,834,889.

BACKGROUND OF THE INVENTION

1. Field of the Invention

This invention relates in general to a cold cathode fluorescent lamp device, and in particular, to a high luminance, high efficiency, long lifetime monochromatic, multi-color or full-color cold cathode fluorescent lamp display (CFD). The invention is particularly useful for use in illumination and for ultra-large screen display device for displaying character, graphic and video image, and for displaying traffic information, for both indoor and outdoor applications.

2. Description of the Prior Art

Hot cathode fluorescent lamps (HCFLs) have been used for illumination. The HCFL operates in the arc gas discharge region. It operates at a relatively low voltage (of the order of 100 volts), large current (in the range of 60 milliamps), high efficiency (such as 80 Im/W), and the cathode is usually operated at a relatively high temperature such as 400° C. Typically, the cathodes would first need to be heated to an elevated temperature by means of a starter and a ballast before the HCFL may be turned on and operated at its optimum temperature. Thus, in order to turn on an HCFL, a voltage is applied to the starter which generates gas discharge. The heat produced by the gas discharge heats up the cathode and an electron emission layer on the cathode to an elevated temperature so that the layer emits electrons to maintain the gas discharge. The gas discharge generates ultraviolet radiation which causes a phosphor layer in the lamp to emit light.

When the cathode and the electron emission layer are first heated to an elevated temperature during starting, the heating causes a portion of the electron emission layer to evaporate, so that after the HCFL has been started a number of times, the electron emission layer may become deficient for the purpose of generating electrons, so that the HCFL needs to be replaced. This problem is particularly acute for displaying information that requires constant starting and turning off the HCFLs. Thus, HCFLs are not practical for use in computer, video, and television applications. For the purpose of illumination, HCFLs requires starters and ballasts, which may also become defective after a period of constant use. This also reduces the lifetime of the HCFL. It is thus desirable to provide an illumination device with improved characteristics.

Currently available traffic light and outdoor large size sign displays are normally made of incandescent lamps. They have high brightness, but many drawbacks:

a. High maintenance cost because of short lifetime and low reliability. This is the case especially for traffic lights or signs on free ways, where changing and repair of the lights are very inconvenient and expensive.

b. High power consumption because of low luminous efficiency, which is about 10 Im/W. For traffic lights and other multi-colored displays, luminance efficiency is even lower because colored light is obtained by filtering white light emitted from the incandescent lamps, so that the colored light so obtained is much reduced in intensity. The effective efficiency for such applications is only 4 lm/W or lower.

c. Under direct sunlight, ON/OFF contrast is very low, i.e., even OFF status looks like ON, which can cause fatal results.

It is, therefore, desirable to provide an improved illumination device which avoids the above-described disadvantages.

A plasma display panel (PDP) type device operates in the gas discharge plasma region. Unlike the HCFL, the electrodes are located not inside the glass tube but outside. As a whole, the plasma region of the tube is electrically neutral. The glass tube typically contains no mercury and contains only an inert gas such as xenon to generate ultraviolet light. The PDP has very low efficiency, usually at about less 1 lm/W. For this reason, PDP a type device is generally not used for illumination at all and is used only for displays.

The major prior technologies for ultra-large screen display are as follows:

A. Incandescent Lamp Display:

The display screen consists of a lot of incandescent lamps. The white lamps are always used for displaying the white and black characters and graphics. The color incandescent lamps, which use red, green, and blue (R, G, B) color glass bubbles, are used for displaying multi-color or full-color characters, graphics and images. The incandescent lamp display has been widely used for outdoor character and graphic displays and possesses certain advantages such as low cost of lamps. Nevertheless, this technology suffers from the following disadvantages: low luminous efficiency (i.e., the efficiency of white lamps being about 10 lm/W; and that of lamps emitting R, G, B light being less than one-third that of white lamps); high power consumption; poor reliability, unexpected lamp failure; short lifetime; expensive maintenance cost; long response time and unsuitable for video display.

B. Light Emitting Diodes (ED):

LED has been widely used for indoor large screen and ultra-large screen display, to display multi-color and full-color character, graphic and video images. This display is able to generate high luminance for indoor applications and can maintain a long operation lifetime at indoor display luminance level. The disadvantages of LED, however, are as follows: low luminous efficiency and high power consumption especially for the ultra-large screen display; low luminance for outdoor application especially the wide viewing angle is required or at direct sunlight; expensive, especially for ultra-large screen display because the need of a lot of LEDs; and lower lifetime at high luminance level.

C. Cathode Ray Tube (CRT):

CRT includes Flood-Beam CRT (e.g., Japan Display '92, p. 385, 1992), and matrix flat CRT (e.g., Sony's Jumbotron as disclosed in U.S. Pat. No. 5,191,259) and Mitsubishi's matrix flat CRT (e.g. SID '89 Digest, p. 102, 1989). The CRT display is generally known for its ability to produce good color compatible with color CRT. The disadvantages of CRT are as follows: low luminance for outdoor applications; low contrast at high ambient illumination operating condition; short lifetime at high luminance operating condition; expensive display device due to complex structure and high anode voltage about 10 kv.

D. Hot Cathode Fluorescent Display:

Hot cathode fluorescent technology has been used in a display system called "Skypix" (SED '91 Digest, p. 577, 1991) which is able to generate high luminance at about 5000 cd/m so that it may have adequate brightness in direct sunlight. The disadvantages of this system are: low luminous efficiency due to hot cathode and short gas discharge arc length; very high power consumption and short lifetime because a hot cathode display requires too many switchings in a video display.

At present, the incandescent lamps are commonly used for outdoor character and graphic displays.

The flat matrix CRT, including flood beam CRT and matrix CRT, is the most common display for outdoor video display. Neither of these two technologies presents a display system which can be used in both indoor and outdoor applications possessing unique features overcoming all or substantially all of the disadvantages described above.

SUMMARY OF THE INVENTION

The present invention has been made in view of the foregoing disadvantages of the prior art.

In one aspect of the invention, a light transmitting container containing a gas medium is used to house at least one cold cathode fluorescent lamp. The gas medium and the container increase luminous efficiency of the at least one lamp by reducing heat lost from the lamp and the effect of the ambient temperature on the lamp.

In another aspect of the invention, a light transmitting container is used to house at least one cold cathode fluorescent lamp having at least one electrode. The container increases the luminous efficiency of the lamp by reducing heat loss from and the effect of ambient temperature on the lamp. An electrical connector connected to the at least one electrode is adapted to be electrically and mechanically connected to one of a number of conventional electrical sockets. In this manner, a gas discharge device formed by the above elements may be used to replace a conventional incandescent lamp.

According to yet another aspect of the invention, a light transmitting container is used to house at least one cold cathode fluorescent lamp having at least one electrode so as to increase the luminance efficiency of the lamp by reducing heat loss from and the effect of the ambient temperature on the lamp. A driver circuit in the container is connected to the at least one electrode to supply power to the lamp. The container containing the lamp and the driver circuit, therefore, form a complete gas discharge device that may be used to replace a conventional incandescent lamp.

According to one more aspect of the invention, a light transmitting container is used to house at least one elongated cold cathode fluorescent lamp having two ends so as to increase the luminous efficiency of the lamp by reducing heat loss from and the effect of the ambient temperature on the lamp. A base plate is used to support the lamp at or near the two ends at two support locations and the base plate is attached to the container. Support means is used to connect a portion of the lamp at a location between the two support locations to the container to secure the lamp to the container. By supporting the lamp at a location between the two support locations, the lamp is less likely to be damaged by vibrations, such as those present in a traveling vehicle.

According to yet another aspect of the invention, a container is used to house at least one cold cathode fluorescent lamp so as to increase luminous efficiency of the lamp by reducing heat loss from and the effect of the ambient temperature on the lamp. The at least one lamp has at least one electrode outside the container. Since the container reduces heat loss from the lamp, if none of the electrodes of the at least one lamp is outside the container, the heat generated by the electrodes would cause the temperature of the lamp to become elevated, thereby reducing the luminous efficiency of the lamp. By placing at least one electrode outside the container, the temperature of the lamp is less likely to become elevated.

According to still one more aspect of the invention, a container is used to house a plurality of cold cathode discharge devices, each device including at least one cold cathode fluorescent lamp. The container increases the luminous efficiency of the plurality of devices by reducing beat loss from and the effect of the ambient temperature on the plurality of the discharge devices. A module housing is used to hold the devices so that the devices are arranged adjacent to one another to form an array that can be used for displaying images.

According to an additional aspect of the invention, a housing is used to hold an array of cold cathode discharge devices, each device including at least one cold cathode fluorescent lamp and a container housing the at least one lamp, so as to increase the luminous efficiency of the at least one lamp by reducing heat loss from and the effect of the ambient temperature on the lamp.

The present invention may advantageously be used for displaying traffic information. Thus, according to one more aspect of the invention, a reflective chamber is used to house at least one cold cathode fluorescent lamp, where the chamber has at least one light output window at one side of the chamber. A substrate is used to support the at least one cold cathode fluorescent lamp and when a voltage is applied to the lamp, the lamp generates light output through the light output window. to display traffic related information.

In another aspect of the invention, a reflective chamber is used to house at least one cold cathode fluorescent lamp, where the chamber has at least one light output window at one side of the chamber. A light condensing apparatus is employed near the light output window to change the angle distribution of output light from the window and to increase utilization factor of light generated by the at least one lamp. When voltage is applied to the lamp, the lamp generates light output through the light output window where upon the output light is condensed by the light condensing apparatus to display traffic related information.

According to still one more aspect of the invention, at least one cold cathode fluorescent lamp having one of a number of different shapes, such as "+", "X" "T", or a combination thereof, may be used for displaying traffic information, where the lamp emits monochromatic, multicolored or red, green and yellow light. A reflective chamber houses the at least one lamp where the chamber defines on one side a light output window. A black substrate supports the lamp in the chamber and a black light shade covers the window to block and absorb incident ambient light. A filter is placed at or near the window to adjust the color of the light emitted from the lamp and to absorb incident ambient light to increase contrast.

BRIEF DESCRIPTION OF THE DRAWINGS

Other objects and many of the attendant advantages of the present invention will be readily appreciated as the same becomes better understood by reference to the following detailed description when considered in connection with the accompanying drawings, wherein:

FIGS. 1(*a*), 1(*b*) show a tiled CCFL assembly type CFD where FIG. 1(*a*) is a partial top view of the CFD to illustrate the preferred embodiment of the present invention.

FIG. 1(*b*) is a partial side cross-sectional view of the device in FIG. 1(*a*) along the line 1*b*—1*b* in FIG. 1(*a*).

FIG. 2 shows some examples of different shapes of CCFL in this invention.

FIG. 3(*a*) is a partial cross-sectional view of a display device with reflectors, CCFLs and shades.

FIG. 3(*b*) is a partial cross-sectional view of a reflector and a CCFL.

FIG. 4 is an embodiment of a CCFL display with heating and temperature control means.

FIG. 8(*a*) is another schematic driving circuit diagram for driving an array of CCFLs of a CFD.

FIG. 8(*b*) is a timing diagram to illustrate the operation of the circuit of FIG. 8(*a*).

FIG. 10(*b*) is a timing diagram to illustrate the operation of the circuit of FIG. 10(*a*).

FIG. 11(*b*) is a timing diagram to illustrate the operation of the circuit of FIG.

FIGS. 20(*b*), 20(*c*) illustrate two possible shapes of CCFLs that may be used in the device of FIG. 20(*a*).

For simplicity in description, identical components are labelled by the same numerals in this application.

DETAILED DESCRIPTION OF THE PREFERRED EMBODIMENTS

Figure 5:
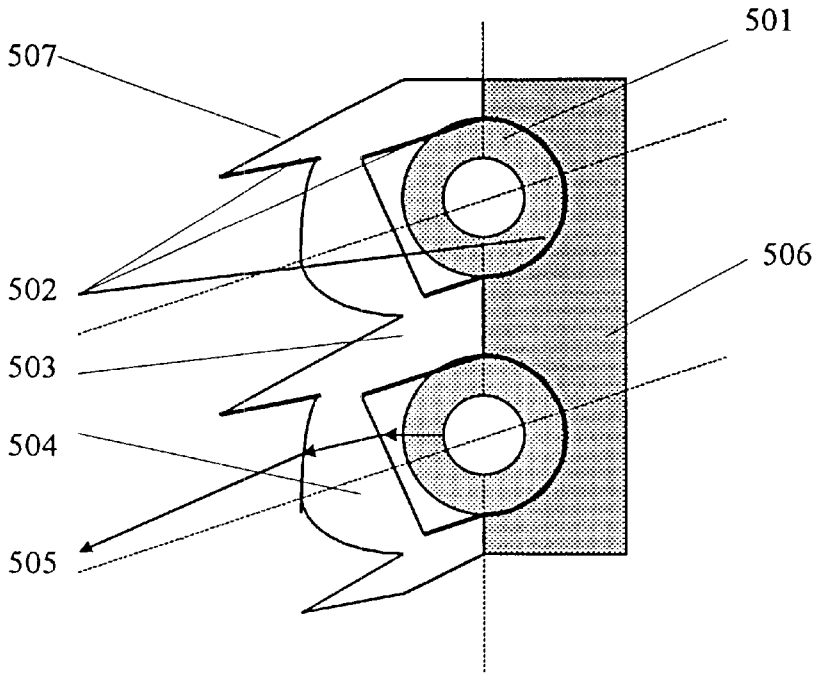
FIG. 5 is a cross-sectional view of an embodiment of CCFL with luminance and contrast enhancement face plate.

The invention of this application may be used for illumination and for display of information, such as traffic information at street intersections and characters and graphic images in television and computer applications.

In one embodiment, the present invention may be used to provide a very high luminance large screen and ultra-large screen display using a shaped cold cathode fluorescent lamp ("CCFL") with a special reflector and luminance enhancement face plate etc. It can be used for both indoor and outdoor applications even in direct sunlight. The dot luminance of the character and graphic display can be up to 15,000 cd/m$^2$ or more. The area average luminance of the full-color image can be up to 5000 cd/m$^2$ or more.

In another embodiment, the present invention may be used to provide long lifetime large screen and ultra-large screen displays. The lifetime of the displays can be up to 20,000 hours or more at high luminance operating condition. The present invention may be used to provide high luminous efficiency, low power consumption large screen and ultra-large screen displays. The luminance efficiency can be up to 30 lm/W or more.

Now, a CFD according to the present invention will be described with reference to the accompanying drawings.

The CFD of the present invention has two types: CCFL assembly type and CCFL lamp type.

The CFD of the present invention can be a single piece structure or a tiled structure. For the ultra-large screen CFD, it is usually made in a tiled type, i.e., the display screen is made as an array of tiles.

FIGS. 1*a*, 1*b* show a tiled CCFL assembly type CDF. FIG. 1(*a*) shows a partial top view of a preferred embodiment of the tiled CFD 101 provided by the present invention and FIG. 1(*b*) further shows a cross-sectional view of the CFD 101 of FIG. 1(*a*) along the line 1*b*—1*b* in FIG. 1*a*. The portion 101 of the CFD shown includes portions of four (4) CFD tiles. Each of the four CFD tiles includes shaped CCFLs 102, which can emit white or R, G and B light. FIG. 1(*a*) is an embodiment of R, G and B full-color CFD. 103 is a pixel which comprises three shaped R, G and B color CCFLs. Generally, although not shown in FIGS. 1*a*, 1*b*, one or more pixels are combined together to form a module and one or more modules combined together to form a display screen to display full-color character, graphic and video images. The R, G and B color CCFLs may be respectively equipped with R, G and B filters whose functions are to absorb the variegated light emitted from gas discharge of the CCFLs to increase color purity, to improve the quality of display images and to increase the contrast of display image by absorbing ambient incident light. Alternatively, the R, G and B CCFLs are made of R, G and B color glass tubes to absorb the variegated light emitted from gas discharge of CCFLs, to increase the color purity and to absorb the ambient incident light to increase the contrast of display image.

The shape of CCFL can be a "U" shape, or a serpentine, circular or other shapes. For the white or monochromatic display, the pixels can be one shaped CCFL or two or more different color CCFLs. 104 is the base plate for the installation of CCFLs 102, its driver 105 and other parts described below. 106 is a black non-reflective surface between CCFLs 102 to absorb the ambient incident light and to increase contrast of display image. 107 are the electrode terminals of CCFLs 102, where electrode terminals 107 are bent towards (not shown) the back of the base plate 104 and are connected (not shown) to the drivers 105. 108 is a reflector. 109 is a luminance and contrast enhancement face plate. 110 is the black shade to absorb the ambient incident light, including sunlight, to increase the contrast of display image. 111 is a heating and temperature control.-means sandwiched between heat conductive plate 112 that is in contact with the CCFLs and heat preservation layer 113 that is in contact with the back plate 104, where means 111 is close to CCFL 102, to make the CCFL operating at an optimum temperature, e.g., 30° C. to 75° C., to enhance the luminance and color uniformity of the display image and to get the high luminous efficiency, high luminance, and to enable fast starting of the display system at any ambient temperature. One tile may have one or several pieces of the heat conductive plate 112 to ensure that all CCFLs are operated at the same optimum temperature. Between the heating and temperature control means 111 and base plate 104, there is a heat preservation layer 113 to decrease the heat loss and to decrease the power consumption.

FIG. 2 shows some examples of the possible shapes of the shaped CCFL 102. The shapes of 201, 202, and 203 are for the white or monochromatic display, and 204, 205 and 206 are for multi-color and full-color displays.

FIGS. 3(*a*) and 3(*b*) are the cross-sectional views of two kinds of reflectors and CCFL for tiled CCFL assembly type CFD as shown in FIG. 1. 301 is the CCFL. 302 is the base plate. 303 is the reflector which is made of a high reflectance layer or film, e.g., Al or Ag or other alloy that form a mirrored surface, or a high reflectance diffusing or scattering surface, e.g., white powder, plastic or paint. The reflector 303 is used for reflecting the light emitted from CCFL forward to viewers at 304. 305 are a plurality of small shades seated between CCFLs to absorb the ambient incident light to increase the contrast of display image. In FIG. 3*b*, the reflector 306 is made of a high reflectance film, e.g., Al or Ag or alloy film, deposited on the back surface of the CCFL.

FIG. 4 shows an embodiment of the heating and temperature control means. 401 is a CCFL. 402 is a reflector. 403 is the base plate. 404 is a heating and temperature control means, e.g., it is made of an electric heating wire or an electric heating film. 406 is a heat conductive plate and each tile has one or more heat conductive plate 406 to ensure that all CCFLs are operated at the same optimum temperature. 407 is a temperature sensor and 408 an automatic temperature control circuit electrically connected to sensor 407 and heating and temperature control means 404. 409 is a heat insulating layer whose function is to decrease the heat loss and decrease the power consumption. 410 is a luminance and contrast enhancement face plate. The chamber between the face plate 410 and heat insulating layer 409 is a heat preservation chamber 411. The temperature of the chamber is controlled at an optimum operating temperature of CCFL, e.g, 30° C. to 75° C.

The heating means 404 can simply be a heated air flow. The heated air flows through the whole screen between the face plate and the base plate. Temperature sensors 407 and control circuits 408 are used to detect and control the temperature of the CCFL chamber.

FIG. 5 is a cross-sectional view of an embodiment of a CFD with a luminance and contrast enhancement face plate. 501 is the CCFL. 502 is the reflector. 503 is the luminance and contrast enhancement face plate, which includes a cylindrical lens or lens array 504 and the small shades 507. The optical axis of the lens is directed towards the viewers. The light emitted from the CCFL can effectively go through the reflector 502 and becomes focused on the lens 504 to a viewer (not shown) at 505 and thus, increase the luminance of display image and the effective luminous efficiency. 506 is a base plate. 507 is a small shade seated at top of the CCFL to absorb ambient incident light, including sunlight, to increase the contrast of display image.

Figure 6:
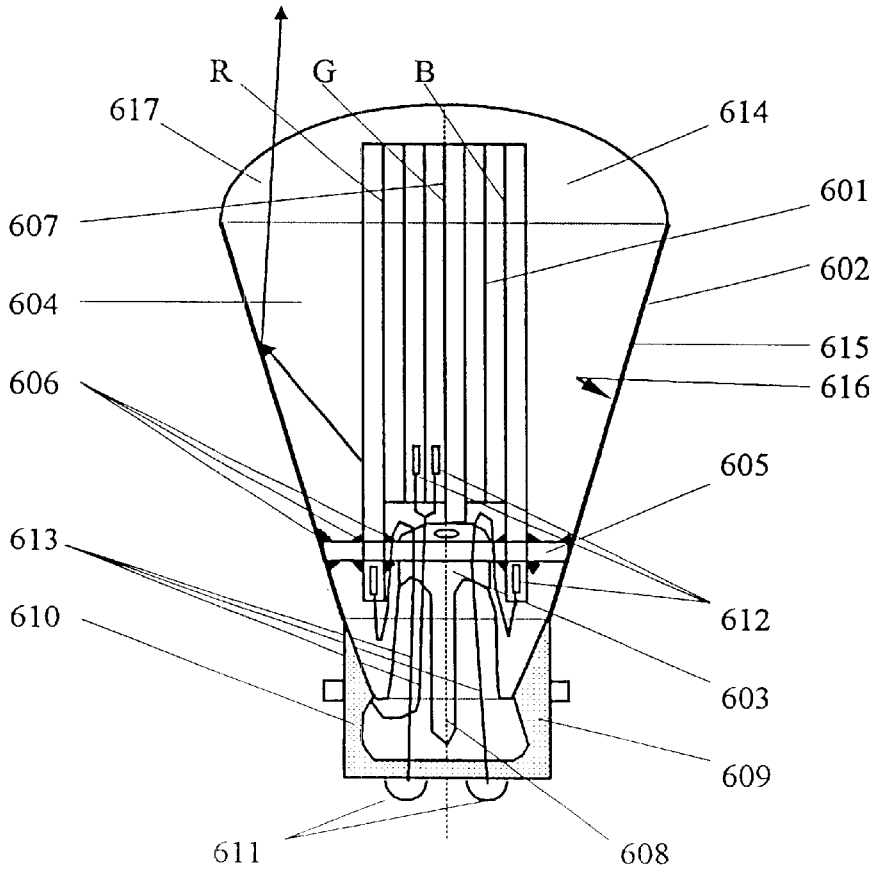
FIG. 6 is a partially cross-sectional view of a luminescent element of a CCFL lamp type CFD.

FIG. 6 shows luminescent elements of a CCFL lamp type CFD. 601 is the CCFL. For the monochromatic or white/black displays, 601 is at least one shaped white or monochromatic CCFL. For the multi-color display, 601 includes at least one group of multi-color CCFLs. For the full-color display, 601 includes at least one group of R, G, B three primary color CCFLs as shown in FIG. 6. 602 is a glass tube. More generally, 602 may be a container or tube made of any light transmitting material, such as glass or plastic, that preferably substantially surrounds the CCFL, so that most of the light emitted by the CCFL will be transmitted through the tube or container 602. 603 is a lamp base which is preferably sealed within the glass tube 602 to form a vacuum chamber 604. Alternatively, chamber 604 may be filled with a gas, such as nitrogen or an inert gas. 605 is a base plate on which the CCFLs are fixed. The base plate 605 is fixed on the lamp base 603 and its edge is attached to the internal surface of the glass tube 602. To obtain a good fixing and sealing effect, a adhesive 606 such as ceramic adhesive is applied between/among the base plate 605, the glass tube 602, the lamp base 603 and the CCFLs. As shown in FIG. 6, most of the light emitted by CCFL 601 is transmitted through tube 602 except for light directed towards base plate 605, which also preferably has a light reflective surface to reduce the light lost.

If the CCFL is made from more than one piece, such as by assembling a number of CCFLs, these CCFLs are also fixed to each other by a adhesive 606. 608 is an exhaustion tube for exhausting the gas in the vacuum chamber 604. 609 is a lamp head which is fixed to the lamp base by a fixing adhesive 610. 611 are connectors of the lamp. 612 are electrodes of the CCFLs; these electrodes are connected to the connector 611 and the lamp head 609 through leads 613. The glass tube 602 can be a diffusing glass tube to obtain a diffusing light. Alternatively, the glass tube 602 shown in FIG. 6 has a front face 614 and a backside 615. The front face 614 is a transparent or a diffusing spherical surface and the backside 615 is a cone shape or a near cone shape tube. The internal surface of the backside 615 of the glass tube, there is a reflective film 616, e.g., an Al, Ag, or alloy thin film, to reflect the light and to increase the luminance of the lamp shown as 617 when viewed from the top in FIG. 6. The vacuum chamber 604 can reduce the heat loss of the CCFL and hence increase the efficiency of the CCFL. In addition, the vacuum chamber 604 can also eliminate any undesirable effects caused by the ambient temperature on the characteristics of CCFL. The base plate 605 is a high reflective plate to reflect the light and to increase the luminance of the CFD. Some of the CCFL lamps shown in FIG. 6 can be used for making the monochromic, multi-color, full-color display system to display character, graphic or video images. The CCFL lamps can be also used for the purposes of illumination. If the CCFL lamps are used for such purpose, reflective film or layer 616 would be omitted so that the backside 615 of tube or container 602 also transmits light.

Figure 12:
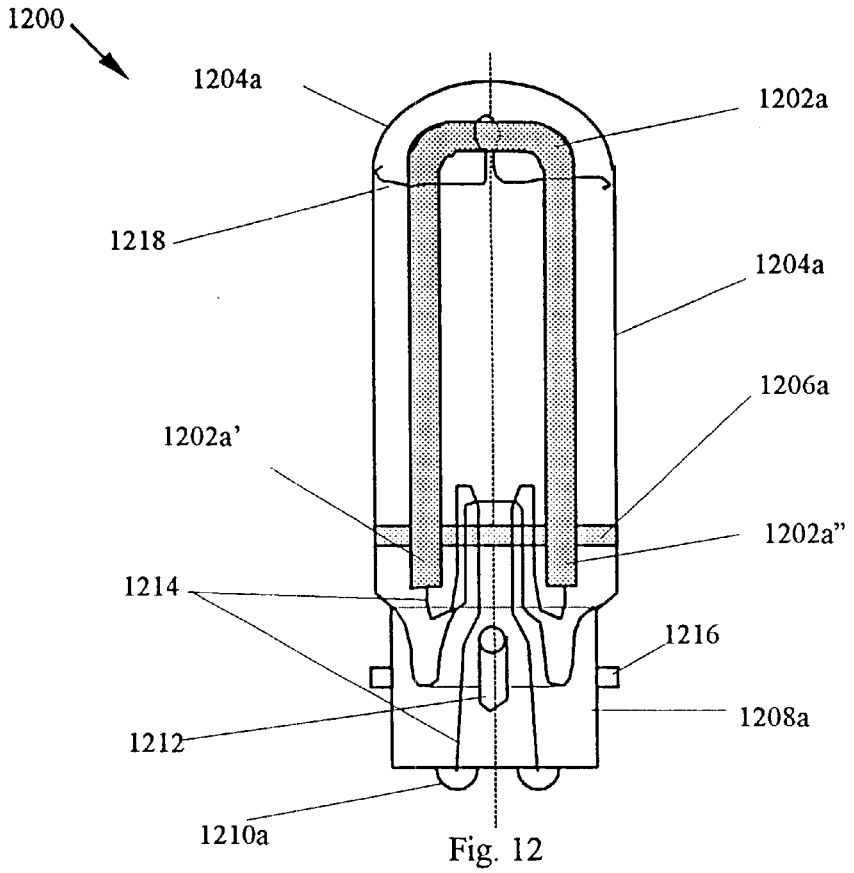
FIG. 12 is a schematic view of a cold cathode gas discharge illumination device suitable for use to replace a conventional incandescent lamp, where support means is employed to prevent the CCFL from excessive vibrations or hitting a container to illustrate an embodiment of the invention. The device of FIG. 12 has an electrical connector that would fit into conventional two prong type electrical sockets.
Figure 13:
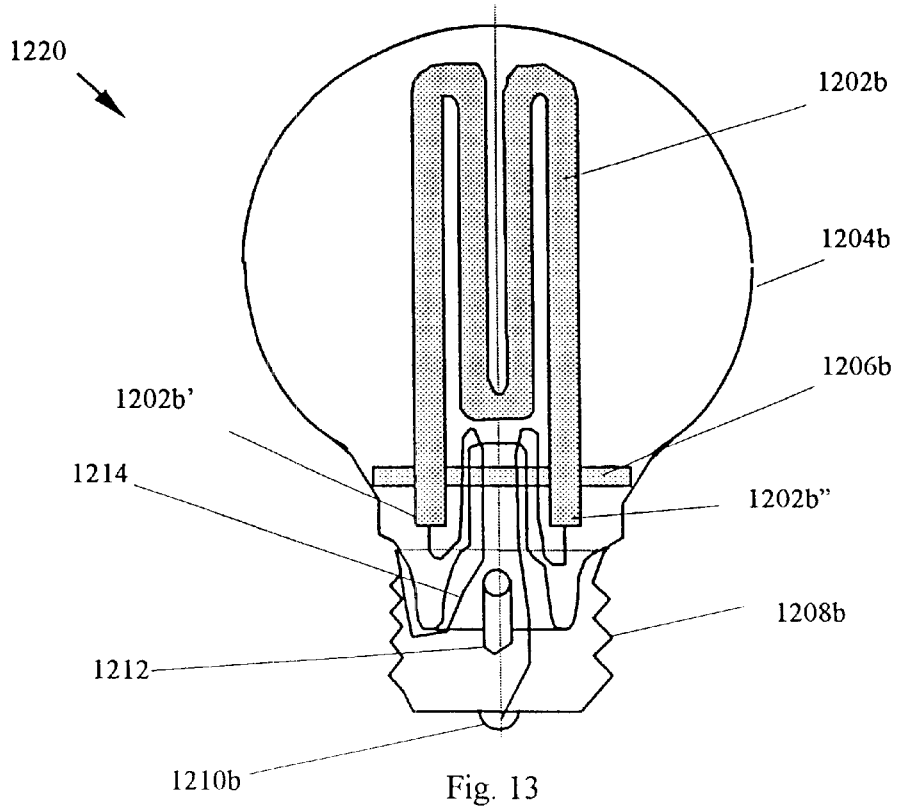
FIG. 13 is a schematic view of a cold cathode gas discharge illumination device with an electrical connector that would fit into conventional spiral type electrical sockets to illustrate another embodiment of the invention.
Figure 15:
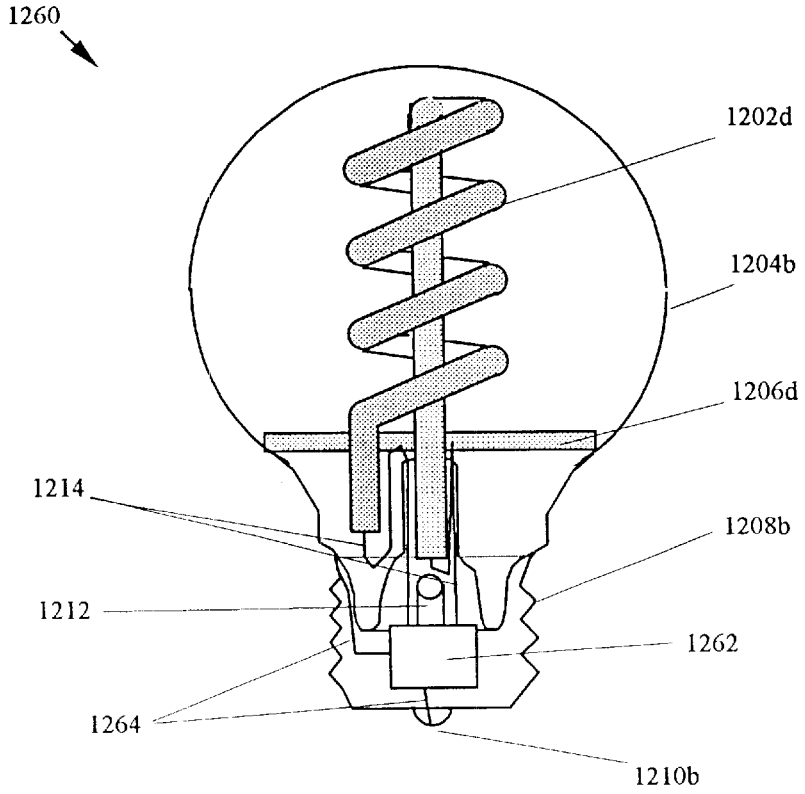
FIG. 15 is a schematic view of a cold cathode gas discharge illumination device employing a spiral-shaped CCFL and a driver for converting 50 or 60 cycle power to higher frequency power to illustrate yet another embodiment of the invention.

The container 602 can also be in shapes other than as shown in FIG. 6, such as that of a sphere as shown in FIGS. 13, 15, or of a cylinder as in FIGS. 12, 17–19, or conical as in FIGS. 6, 16, and 20(*a*) as described below, or even that of an ellipsoid.

Figure 7:
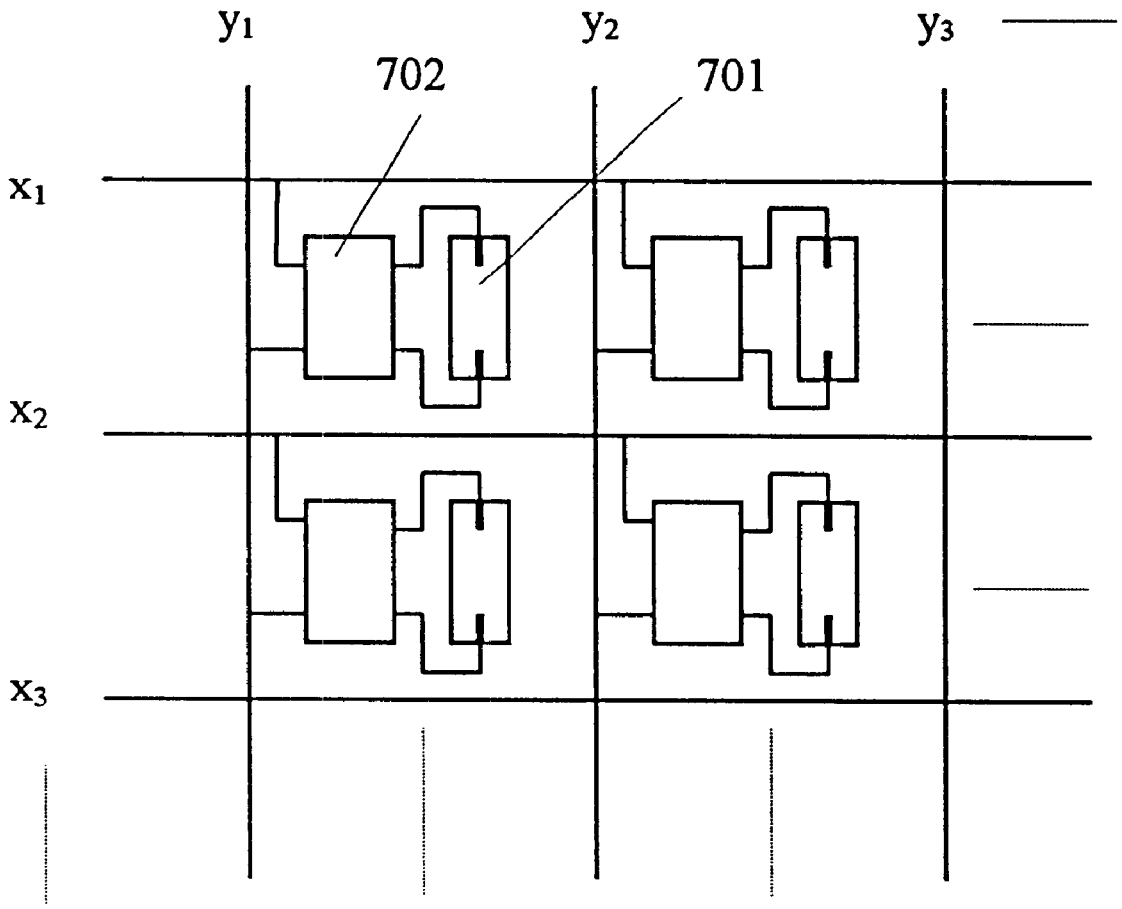
FIG. 7 is a schematic driving circuit diagram for driving an array of CCFLs of a CFD.

Referring now to FIG. 7, the driving circuit of CFD is schematically diagramed. 701 are the CCFLs. 702 are DC/AC converters which change the DC input voltage to a high voltage and high frequency (e.g., tens kHz,) AC voltage to drive the CCFL. The symbols $x_1$, $x_2$ . . . are scanning lines. The symbols $y_1$, $y_2$ . . . are column data electrodes. One DC/AC converter 702 drives one CCFL 701. By controlling the time period of input voltage of the DC/AC converter 702 applied to CCFL 701 according to an image signal, the luminance of CCFL can be controlled and the character, graphic and the image can be displayed.

The CFD as illustrated in FIG. 7 will need a lot of DC/AC converters to drive its CCFLs. In order to reduce the number of DC/AC converters and to reduce the cost of the display system, a method which uses one DC/AC converter driving one line of CCFL or one group of CCFL can be adopted as shown in FIG. 8(*a*). FIG. 8(*b*) is a timing diagram to illustrate further the operation of the circuit of FIG. 8(*a*). 801 are the CCFLs. 802 are the DC/AC converters. 803 are coupled capacitors. The symbols $x_1$, $x_2$ . . . are scanning lines. The symbols $y_1$, $y_2$ are column data electrodes. When one scanning line, e.g., $x_1$, is addressed (FIG. 8(*a*), $t_{ON}$), the related DC/AC converter is turned ON to output a sustained AC voltage shown as 804 applied to the scanning lines. This sustained voltage is lower than the starting voltage of CCFL, and can not start the CCFLs of this line, but can sustain lighting after the CCFLs are started. Because the starting voltage (e.g. 1.5 KV) of CCFL is much larger than the sustaining voltage (e.g. 500 V ), when the column data electrode ($y_1$, $y_2$, . . . ) is at 0 v, the related CCFL can not be started and will stay at OFF state. When the column data electrode $y_1$, $y_2$, . . . supplies an anti-phase trigger voltage 805, the related CCFL will be started. The CCFL will light until the corresponding addressing DC/AC converter is turned OFF as shown in FIG. 8(*b*) at $t_{OFF}$. The lighting period $t_m$ according to the image signal can be controlled to modulate the luminance of CCFL and to display character, graphic, and image with monochromatic or multi-color or full-color. For example, trigger pulse 805 is for a high luminance signal 806, where the lighting period is $t_{m1}$, ($=t_{OFF}-t_{ON1}$); trigger pulse 807 is for the lower luminance 808, where the lighting period is $t_{m2}$ ($=t_{OFF}-t_{ON2}$) and so on.

Figure 9:
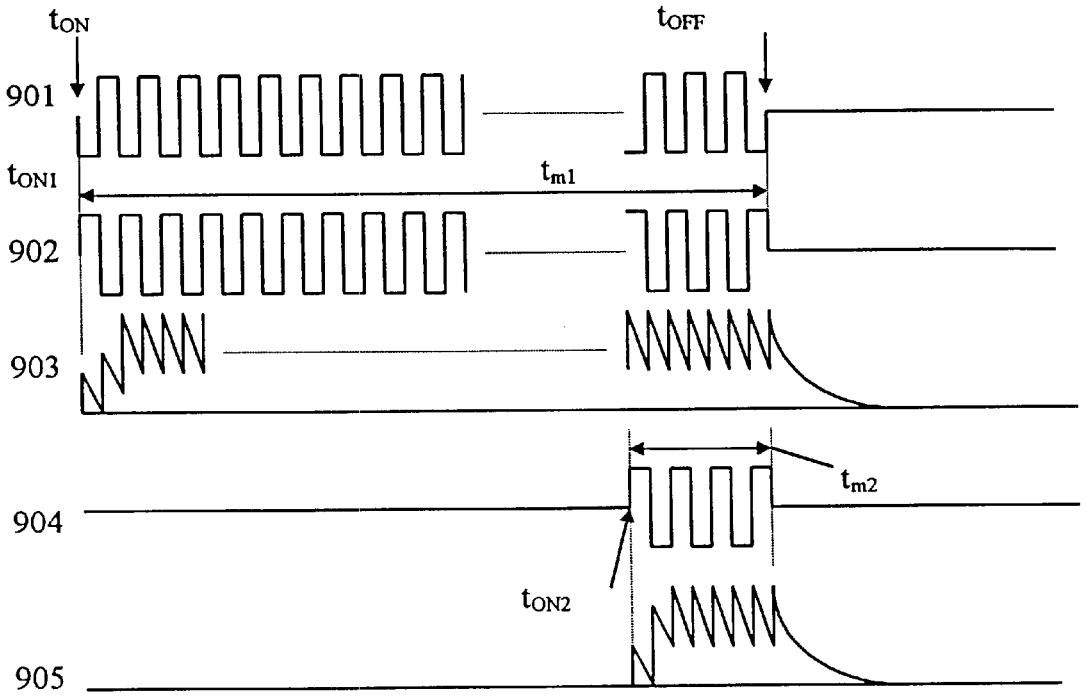
FIG. 9 is a timing diagram to illustrate another operating method of the circuit of FIG. 8(*a*).

FIG. 9 shows a different operating method of the circuit shown in FIG. 8(*a*). 901 is the same as 804 as shown in FIG. 8(*b*) for line scanning applied through lines $x_1$, $x_2$, . . . 902 and 904 are the column data voltage applied through column data electrodes $y_1$, $y_2$, . . . , which have an anti-phase with the scanning voltage 901. In other words, voltages 902, 904 have a phase that is opposite to that of voltage 901. When the scanning voltage 901 and the signal voltage 902 are applied to a CCFL at the same time, the total voltage applied to the CCFL will be larger than the starting voltage of the CCFL which will light the CCFL in this period. The ON time $t_{m1}$ and $tm_2$, i.e., lighting period, will depend on image signals. Different tm have different lighting periods shown as 903 and 905, i.e., different luminance, to display character, graphic and image.

Figure 10:
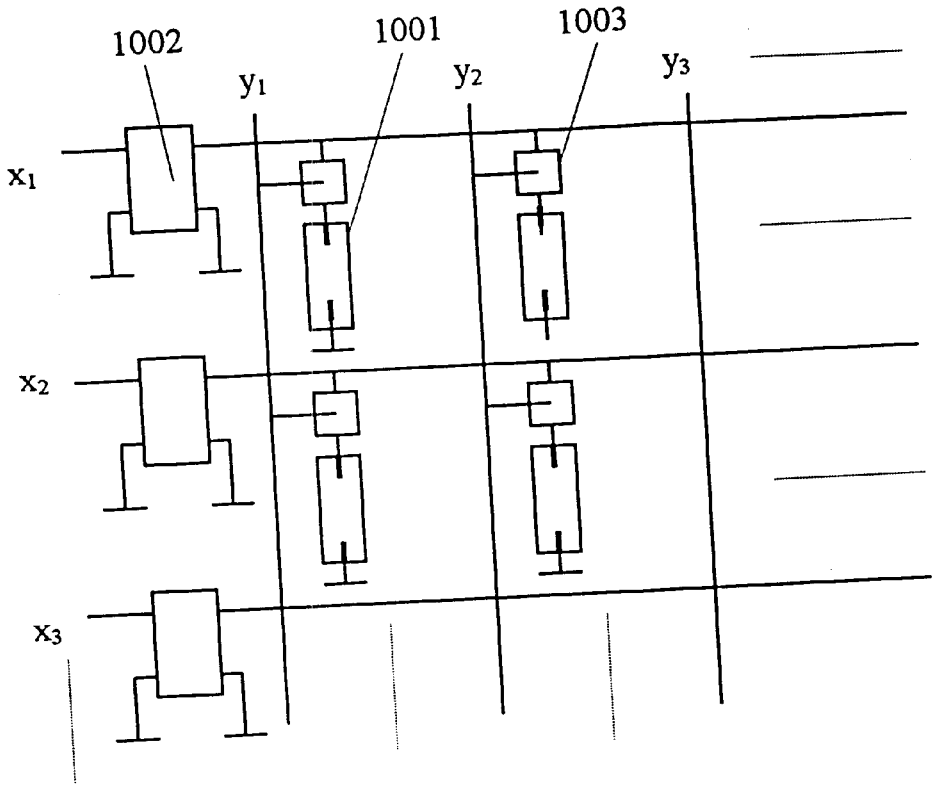
FIG. 10(*a*) is an alternative schematic driving circuit diagram for driving an array of CCFLs of a CFD.
Figure 10:
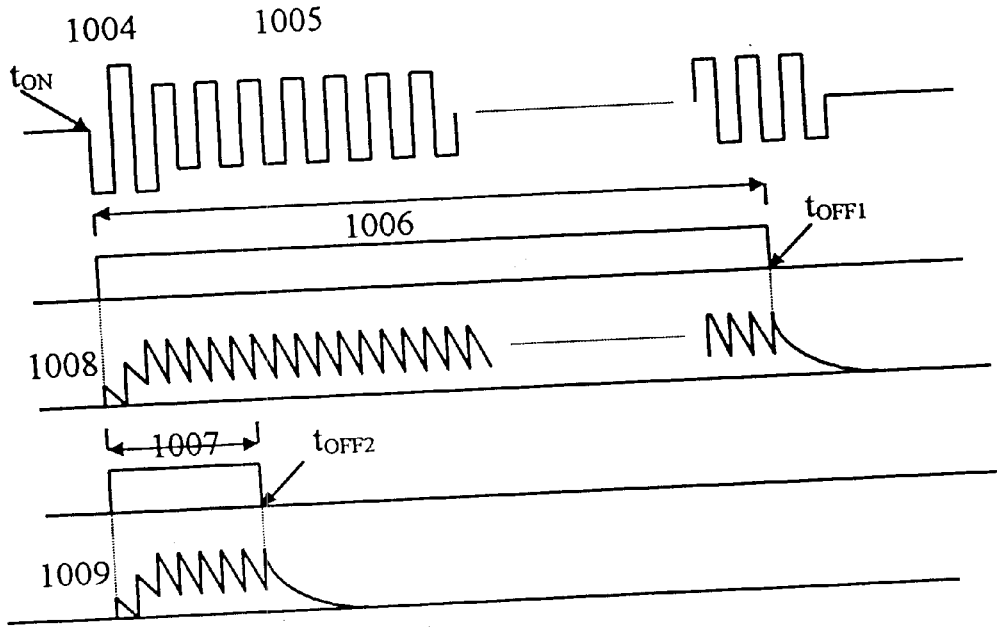

FIG. 10(*a*) is yet another schematic diagram for the driving circuit of CFD. The symbols $x_1$, $x_2$ . . . are the scanning lines. The symbols $y_1$, $y_2$ . . . are the column data electrodes. 1001 are the CCFLs. 1002 are the DC/AC converters. 1003 are AC voltage switches. One line of CCFL or one group of CCFLs has one DC/AC converter 1002. When the switch 1003 is turned ON according to the image signal, the related CCFL will be lighted, and the character, graphic and image can be displayed. In this case, because the starting voltage of CCFL is larger than the sustained voltage, all CCFLs in the same line or same group should start at the same time as shown in FIG. 10(*b*) as $t_{ON}$. At this time, the related DC/AC converter will be turned ON to output a larger voltage 1004, which can start the CCFL. Consequently, all the CCFLs connected with this DC/AC converter are started at this time if the related switch is turned ON. After the CCFL starts, the DC/AC converter will output a lower sustained voltage 1005 to sustain the CCFL lighting. The turn OFF time $t_{OFF}$ of the switch is dependent on the image signal. In other words, by controlling the turning off times of the switches, different $t_{OFF}$, e.g., $t_{OFF1}$, and $t_{OFF2}$, can be obtained to achieve different lighting periods, e.g., 1006 and 1007, different luminance 1008 and 1009 can be obtained to display the character, graphic and image.

Figure 11:
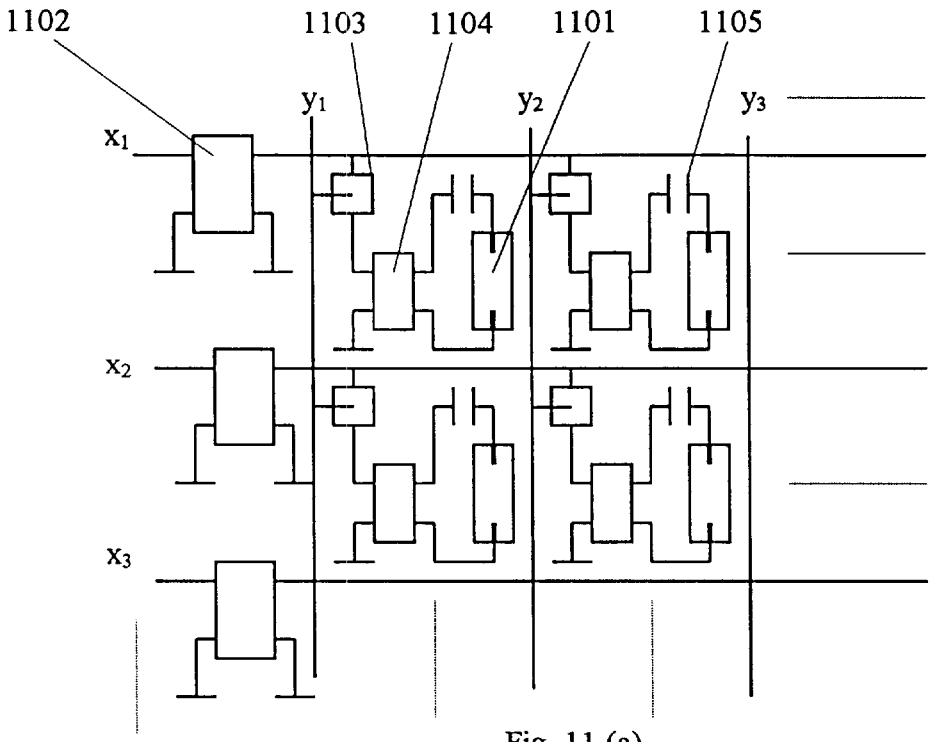
FIG. 11(*a*) is a different schematic driving circuit diagram for driving an array of CCFLs of a CFD.
Figure 11:
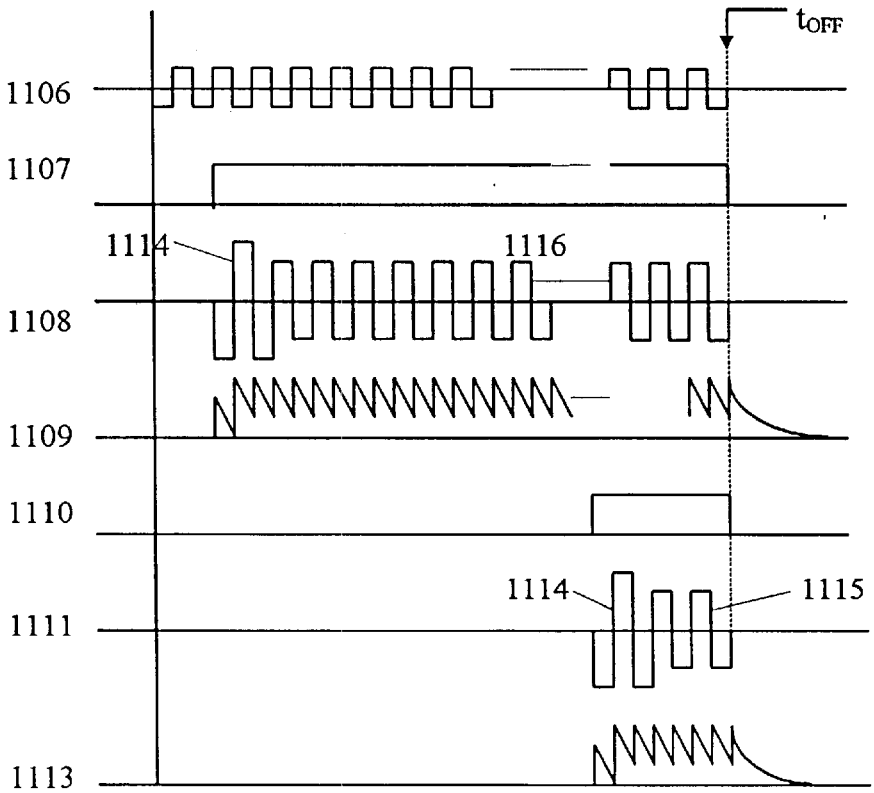

FIG. 11(*a*) shows a low AC voltage switch driving circuit. The symbols $x_1$, $x_2$ . . . are scanning fines. The symbols $y_1$, $y_2$ . . . are column data electrodes. 1101 are the CCFLs. 1102 are DC/AC converters, which output a low AC voltage, e.g., several to ten volts and tens kHz. One line of CCFLs or one group of CCFLs has one DC/AC converter. 1103 are low AC voltage switches. 1104 are transformers from which the low AC voltage can be changed to a high AC voltage. 1105 are coupling capacitors. The driving timing diagram is shown in FIG. 11(*b*). 1106 is the low AC voltage output from the DC/AC converter when the line is addressed. 1107 and 1110 are the AC switch control voltage signals from the column data electrodes, where the widths of the voltage signals are dependent on the intensity to be displayed as indicated by image signals. 1108 and 1111 are the high AC voltage output from the transformers. 1109 and 1113 are the light waveforms emitted from the CCFLs. When an AC switch is turned ON, the related transformer will output a higher voltage 1114 to start the related CCFL. After the CCFL is started, the transformer output a lower sustained voltage 1115, 1116 to sustain the CCFL lighting. When the DC/AC converter 1102 is turned OFF, shown as $t_{OFF}$, all the addressed CCFLs are turned OFF. By controlling the ON time of the AC switch according to image signals on the column data electrodes $y_1$, $y_2$, . . . , the luminance of the CCFL can be modulated to display the character, graphic and image.

The description below in reference to FIGS. 12–15, 17–19 pertain to CCFLs used as illumination devices. Thus, it is desirable for the containers in these figures for housing the lamps in these devices to be light transmitting and to surround the lamps so that the lamps emit light in substantially all directions except for perhaps a small area needed to support the lamps, from which area light may be reflected, instead. In other words, the containers themselves preferably would include no reflecting surfaces. As shown in FIG. 12, illumination device 1200 includes a CCFL 1202*a* enclosed within a container 1204*a* which can be made of any light transmitting material such as glass or plastic. The CCFL 1202*a* is elongated and has two ends 1202*a*' and 1202*a*". The CCFL 1202*a* is held in place by a base plate 1206*a*, where the two ends 1201*a*', 1202*a*" of the CCFL are inserted into matching holes in the base plate, and the base plate is attached at its edge to the inner wall of container 1204*a* by an adhesive such as a ceramic adhesive in a manner as that described above. Container 1204*a* is attached to a lamp holder 1208*a*. Attached to lamp holder 1208*a* are two electric connectors 1210*a*. Lamp holder 1208*a* is also provided with two fingers or protrusions 1216 adapted to fit into notches (not shown) in a conventional spring loaded electrical socket (not shown), such as those typically used for incandescent lamps; such conventional sockets are also known as two prong sockets. With the connectors 1210*a* and lamp holder 1208*a* with fingers 1216 configured as shown in FIG. 12, the illumination device 1200 is adapted to fit into the spring loaded type of conventional electrical sockets which have notches into which fingers 1216 fit. In this manner, illumination device 1200 may be used to replace conventional incandescent lamps in conventional electrical sockets, without having to alter the configuration of the socket.

Where container 1204*a* is to be evacuated to result in a vacuum chamber, this can be performed through exhaust tube 1212. As described above, by placing CCFL 1202*a* in the vacuum chamber, heat lost from the CCFL can be reduced to maintain the CCFL at an elevated temperature, such as a temperature within the range of 30–75° C., which would improve the luminous efficiency and lifetime of the CCFL. Alternatively, a gas such as an inert gas may be injected into the chamber and enclosed by container 1204*a*. In such event, it is preferable for a small hole, e.g. through the exhaust tube 1212, to be maintained between the chamber enclosed by container 1204*a* and the atmosphere so that expansion and contraction of the gas due to temperature changes will not damage the container. By placing CCFL 1202*a* in the enclosed gas in the container 1204*a*, heat lost from the CCFL can be reduced to maintain the CCFL at an elevated temperature, such as a temperature within the range of 30–75° C., which would improve the luminous efficiency and lifetime of the CCFL.

Since the CCFL 1202*a* is elongated, if the device 1200 is used in a transport vehicle, device 1200 may be subject to vibrations. When device 1200 is used in, for example, an airplane, such vibrations can be of high amplitude. For this reason, it may be desirable to employ a support means, such as a spring 1218 connecting preferably a mid-portion of the CCFL to the inner walls of the container 1204*a*, so that vibrations of device 1200 will not cause the CCFL to be subject to inordinate strain or hit the container. It may be adequate for the spring 1218 to be simply in contact with container 1204*a*, and it may be adequate for spring 1218 to connect to the inner wall of the container a portion of the CCFL located away from the mid-portion of the CCFL but still between the two ends.

FIG. 13 illustrates another configuration of an illumination device which may be used to replace commonly used incandescent lamps. A CCFL 1202*b* is enclosed within a container 1204*b* which is generally spherical in shape, as opposed to the elongated or cylindrical shape of container 1204*a* in FIG. 12.

As in FIG. 12, the two ends 1202*b*', 1202*b*" of the CCFL are inserted into matching holes in the base plate 1206*b* which, in turn, is glued to the inner wall of container 1204*b* in a manner as described above in reference to FIG. 12. Attached to container 1204*b* is a lamp holder 1208*b* designed to fit into a conventional electrical socket having a spiral-shaped connector. Lamp holder 1208*b* is shaped to also have a spiral-shaped outside electrically conductive surface to fit into the spiral-type conventional electrical sockets. Electrical connector 1210*b* is adapted to contact the matching or corresponding electrical connector in the bottom portion a conventional spiral-type electrical socket (not shown). Again the chamber in container 1204*b* may be evacuated by means of exhaust tube 1212, or an inert gas may be injected there through. Electrical connectors, such as wires 1214, connect the CCFL to the electrical connector 1210*b* and the other electrical connector on the spiral surface of holder 1208*b*. Thus, illumination device 1220 may again be used to replace incandescent lamps to fit into spiral-type conventional electrical sockets, without having to change the configuration of the socket.

Figure 14:
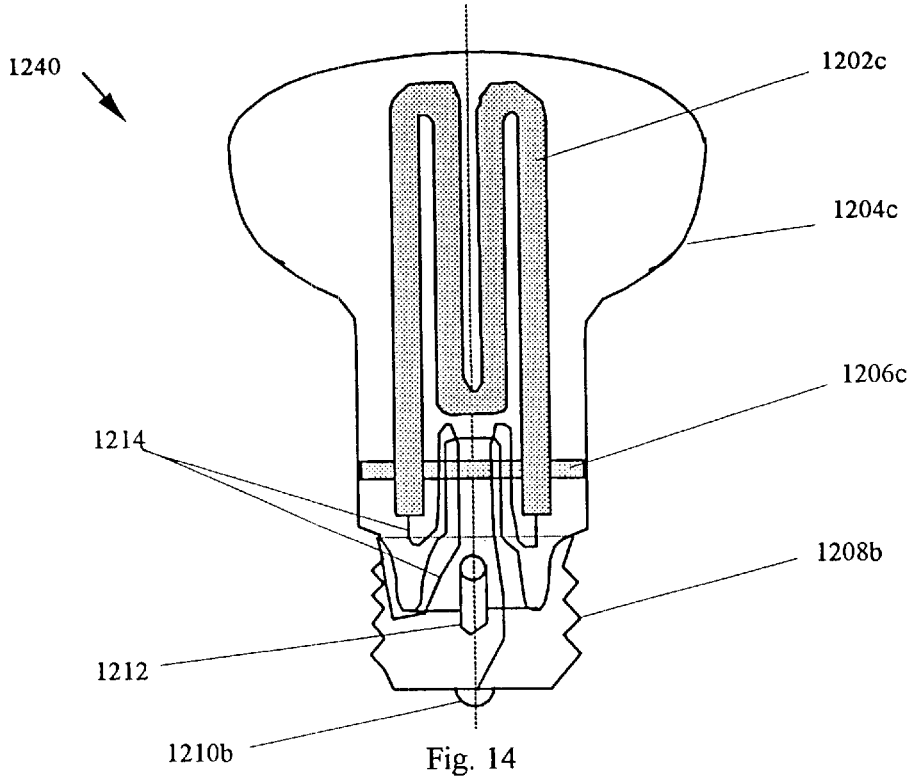
FIG. 14 is a cross-sectional view of a cold cathode gas discharge illumination device to illustrate another embodiment of the invention.

FIG. 14 illustrates yet another configuration of an illumination device which may be used in place of incandescent lamps to fit into conventional spiral-type conventional sockets. Device 1240 differs from device 1220 in the shape of the container 1204*c*. Other than such difference, device 1240 is essentially the same as device 1220.

FIG. 15 is a schematic view of another illumination device 1260 to illustrate another embodiment of the invention. The same as devices 1220, 1240, device 1260 is adapted to replace incandescent lamps and would fit into conventional spiral-type sockets without having to change the socket configuration. Device 1260 differs from device 1220 in the following respects. The CCFL 1202*d* has a spiral shape rather than a "M" shape as in devices 1220, 1240 of FIGS. 13, 14. Furthermore, device 1260 includes a driver 1262. CCFLs typically operate at a higher frequency than the 60 or 50 cycles per second AC that is normally provided by power companies. For this purpose, it is preferable to include a driver 1262 in the illumination device 1260 which can convert a 50 or 60 cycle frequency AC provided by the power company into the desired operating frequency preferably in a range of about 30 to 50 kHz for operating the CCFL. By providing a driver 1262 as an integral part of the illumination device 1260, the voltage supplied to connectors 1210*b* and the other electrical connector on the outside spiral surface of lamp holder 1208*b* need not be first converted to a high frequency signal, so that illumination device 1260 may be directly installed into a conventional electrical socket, without requiring any change in the 50 or 60 Hz AC power supplied by power companies. Electrical connectors such as wires 1264 connect driver 1262 to electrical connectors 1210*b* and that on the spiral surface of lamp holder 1208*b*. Electrical connectors such as wires 1214 connect the driver 1262 to the CCFL 1202*d*.

Figure 16:
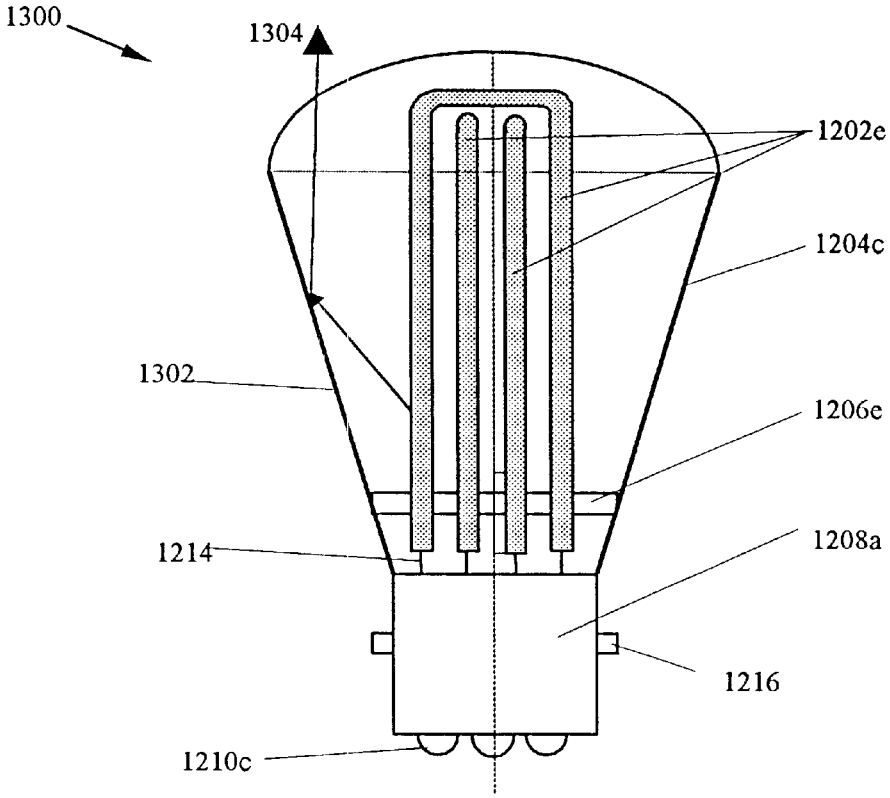
FIG. 16 is a cross-sectional view of a cold cathode gas discharge illumination device employing three CCFLs for displaying red, green and blue light to illustrate one more embodiment of the invention.

FIG. 16 illustrates another illumination device 1300 comprising three "U" shaped CCFLs 1202*e*, such as one CCFL for displaying red light, one for displaying green light and the remaining one for displaying blue light, so that device 1300 may be used for displaying images. The "U" shape of the CCFL is apparent for only one of the CCFLs, the other two CCFLs being viewed from the side so that their "U" shape is not apparent from FIG. 16. The three CCFLs 1202*e* are housed in a container 1204*c* which has a generally spherical top portion and a substantially conical bottom portion, as in the container of FIG. 6 described above. Similar also to the device in FIG. 6, the inner wall of the conical portion of the container 1204*c* is provided with a reflective film 1302 to reflect a ray 1304 of light from the CCFL towards a viewer (not shown). A pair of electrical connectors 1210*c* is provided for each of the three CCFLs, so that the three CCFLs may be individually controlled. In this manner, illumination device 1300 may be controlled to display red, green or blue light either by itself, or together in any combination.

Figure 17:
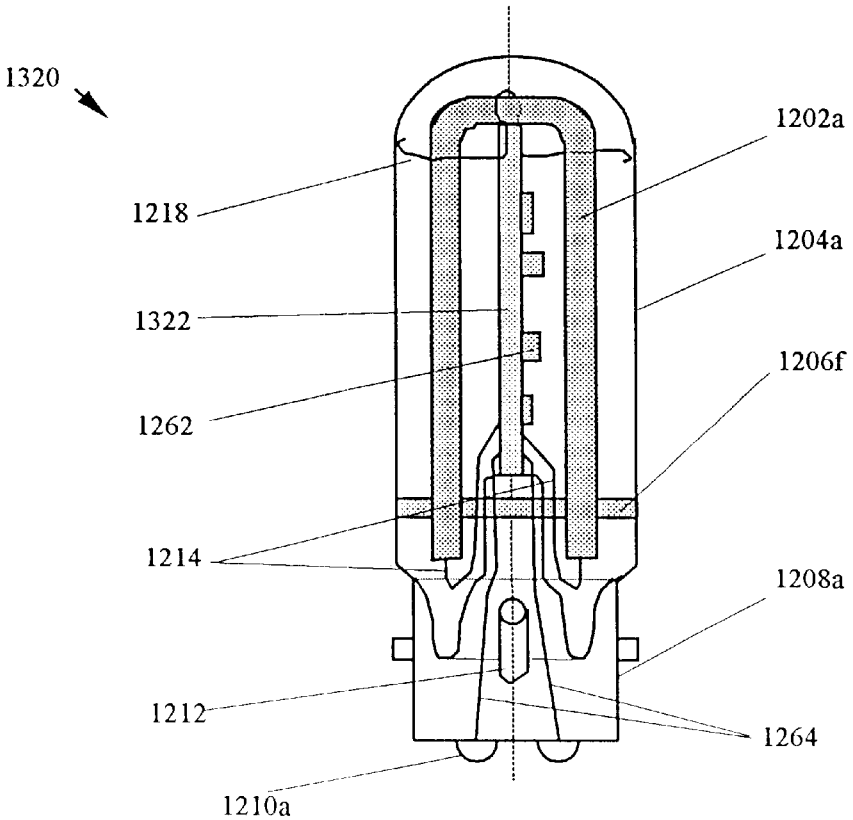
FIG. 17 is a schematic view of a cold cathode gas discharge illumination device where a printed circuit board and a driver are employed for supplying power to the CCFL.

FIG. 17 is a schematic view of illumination device 1320 to illustrate another embodiment of the invention. Device 1320 is similar to device 1200 of FIG. 12 in many respects and differs from device 1200 in that a substrate 1322, such as a printed circuit board, is placed in the container 1204*a* for supporting a driver 1262 which performs the same function as that described above for device 1260 of FIG. 15, whereby the driver converts the 50 or 60 Hz AC power from the power company to a high frequency AC signal suitable for operating CCFLs. Electrical wires 1214 connect driver 1262 to the CCFL 1202*a* and electrical wires 1264 connect the driver 1262 to electrical connectors 1210*a*. The printed circuit board and the driver preferably have light reflective surfaces to optimize light emitted by the devices 1320 and 1260.

Figure 18:
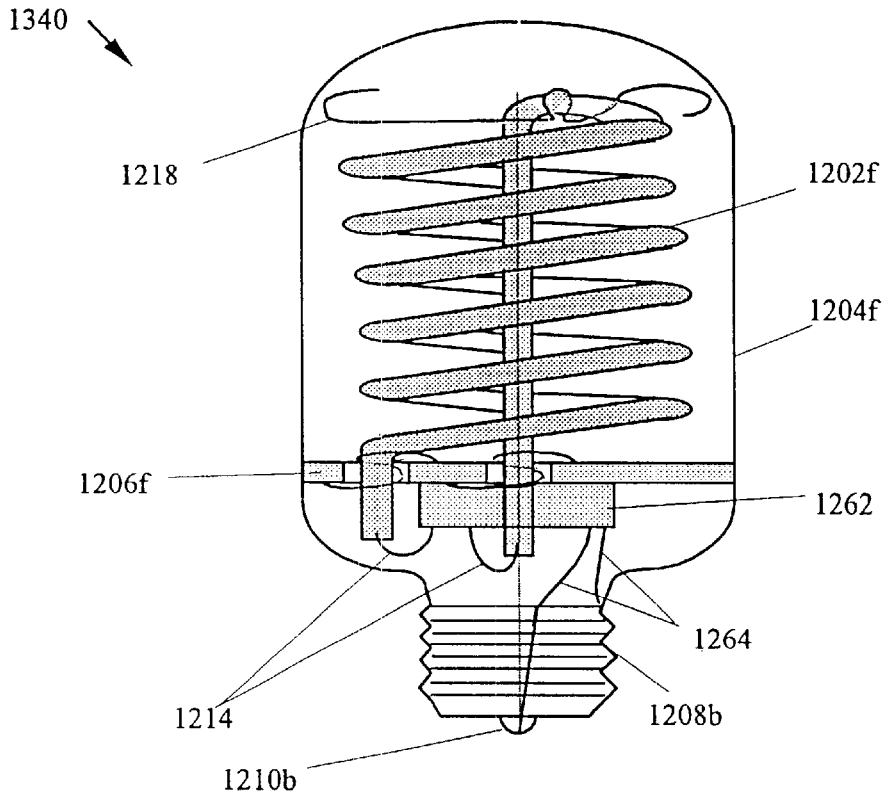
FIG. 18 is a schematic view of a cold cathode gas discharge illumination device employing a spiral-shaped CCFL with support means and driver to illustrate yet another embodiment of the invention.

FIG. 18 is a schematic view of yet another illumination device 1340 to illustrate another embodiment of the invention. Spiral shaped CCFL 1202*f* is housed in a container 1204*f* which is generally cylindrical in shape. Spring 1218 is connected to a portion of the CCFL intermediate between the two ends of the CCFL and inner walls of the container to stabilize the position of the CCFL in the container, so that vibrations of device 1340 will not cause the CCFL to be subject to inordinate strain or hit the container. The two ends of the CCFL are inserted into matching holes in the base plate 1206*f* and a driver 1262 is used for converting the 50 or 60 Hz AC from the power company to a higher frequency power for the CCFL. The electrical connections connecting the CCFL, driver, and electrical connectors in FIG. 18 are similar to those described above for FIG. 15.

Figure 19:
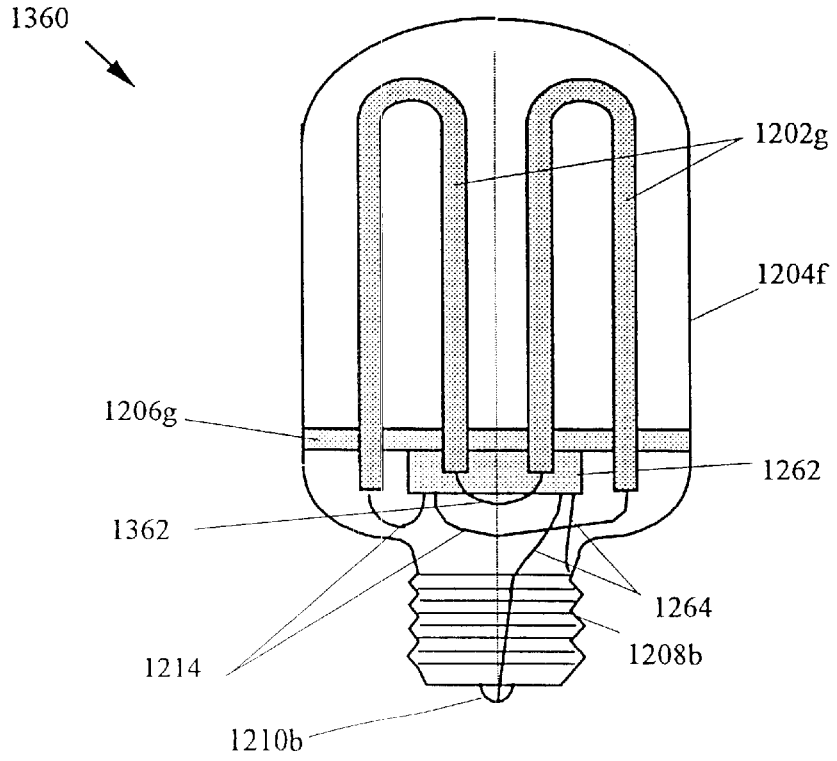
FIG. 19 is a schematic view of a cold cathode gas discharge illumination device employing a double "U"-shaped CCFL to illustrate an embodiment of the invention.

FIG. 19 is a schematic view of another illumination device 1360 to illustrate yet another embodiment of the invention. Device 1360 includes two "U" shaped CCFLs, whose two ends are inserted into matching holes in base plate 1206*g* for holding the CCFLs to the container. The operation of the driver 1262 and the wire connections in device 1360 are similar to those described above for device 1340, except that the two CCFLs are connected by an additional wire 1362.

Figure 20:
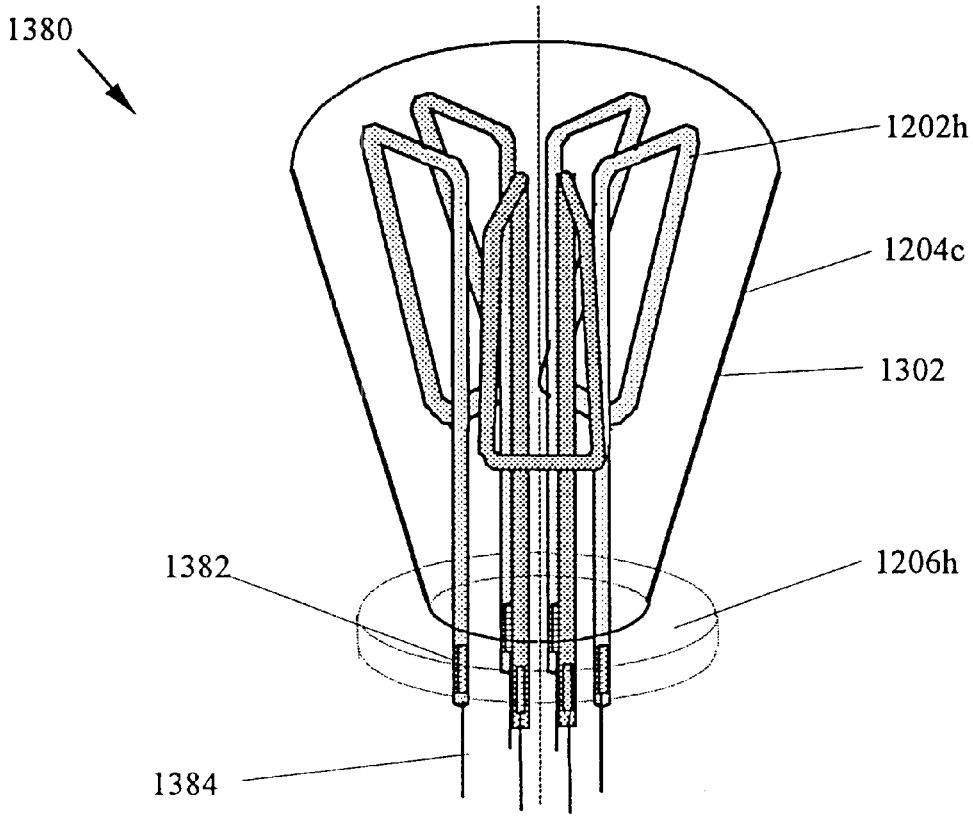
FIG. 20(*a*) is a perspective view of a cold cathode gas discharge illumination device to illustrate one more embodiment of the invention.
Figure 20:
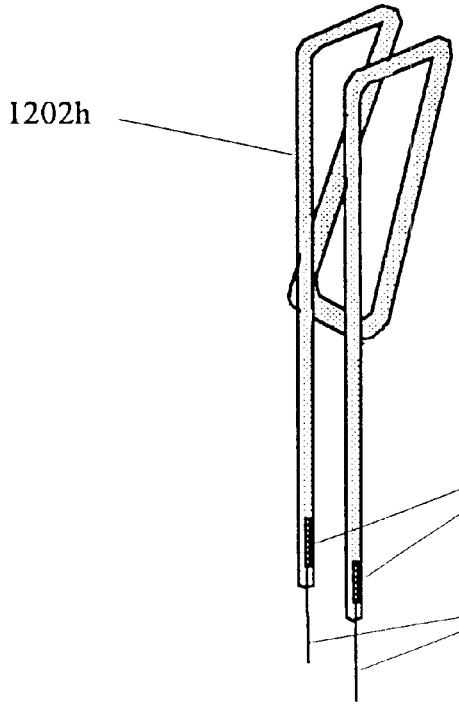
Figure 20:
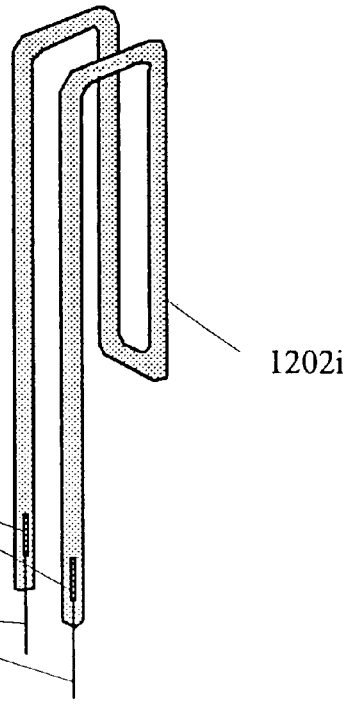

FIG. 20(*a*) is a perspective view of a cold cathode gas discharge apparatus 1380 to illustrate an embodiment of the invention. A container 1204*c* is used for housing three CCFLs 1202*h*, where the container is substantially the same as that used in FIG. 6. Where discharge device 1380 is used with a narrow viewing angle from the top of the device, a light-reflective layer 1302 may be employed on the inner or outer surface of the container to refract light toward the viewing direction in the same manner as shown in FIG. 16. Where device 1380 is used for illumination, by emitting light in substantially all directions, such reflective layer may be omitted. Container 1204*c* is sealingly attached to and sitting on a base plate 1206*h* and each of the three CCFLs 1202*h* has two ends that are inserted through matching holes in the base plate, so that the electrodes 1382 located at the ends of the CCFLs are outside the sealed or enclosed chamber in container 1204*c*. The connectors 1382 are connected to a power supply (not shown) through wires 1384. The base plate 1206*h* may be connected to a lamp holder of the two-pronged type 1208*a* or the spiral-type 1208*b* shown in FIGS. 12–19. Wires 1384 may be connected to electrical connectors of the two-prong or spiral-type connectors in the same manner as that shown in FIGS. 12–19, where the lamp holder may or may not include driver 1262. Where a plurality of discharge devices 1380 are arranged in a two-dimensional array for displaying characters and graphic images, the base plate 1206*h* may be connected to a module holder housing shown in FIG. 25 described below.

The CCFLs 1202*h* have a shape shown more clearly in FIG. 20(*b*). Since the amount of light generated by the CCFL is proportional to the length of the CCFL that can be held within a given volume, it is preferable to employ a CCFL comprising two parallel elongated tubes connected at the end to form a loop, and where the parallel tubes are bent back towards itself to increase the length of the CCFL within the container.

FIG. 20(*c*) is a perspective view of another CCFL 1202*i* having a shape that is essentially the same as 1242*h* but does not bend towards itself to the extent that is the case in 1202*h*. Obviously, other shapes of CCFLs obtained by bending two parallel tubes connected at the end into various shapes may be employed and are within the scope of the invention.

In the operation of the CCFL, a relatively high voltage is applied to the CCFL. For this reason, typically a significant voltage drop develops across the electrodes connected to the CCFL. Such heat generated is proportional to the voltage drops across the electrodes, large voltage drops may cause significant heat to be generated at the electrodes. As noted above, CCFLs have higher luminous efficiency and longer lifetimes if operated at an elevated temperature, such as a temperature in the range of about 30–75° C. For this reason, the CCFL is placed in an enclosed chamber to reduce heat loss and to maintain the elevated temperature of the CCFL, where the chamber is evacuated or filled with a gas such as nitrogen or an inert gas. Thus, if the electrode for applying a voltage to the CCFL is within the enclosed chamber, the heat generated by the electrode may cause the temperature of the CCFL to rise to above its optimal operating temperature range. For this reason, it may be desirable to place the electrode outside the enclosed chamber in the manner shown in FIG. 21.

Figure 21:
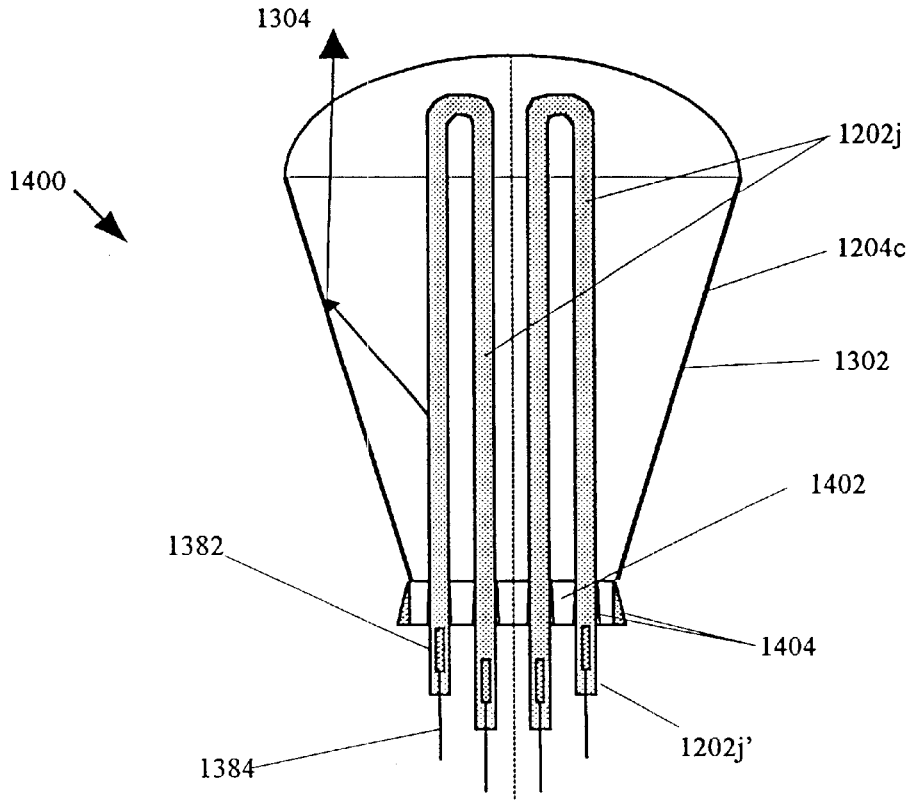
FIGS. 21 and 22 are schematic views of cold cathode gas discharge illumination devices where at least some of the electrodes for applying voltages to the CCFLs are placed outside of the chambers containing the CCFLs to facilitate heat dissipation.

In reference to FIG. 21, the CCFLs 1202*j* have ends 1202*j*' which extend through a support plate 1402, preferably made of glass, ceramic or plastic, so that these ends are outside the chamber enclosed by container 1204*c*. As shown in FIG. 21, each of the ends 1202*j*' of the CCFLs is provided with an electrode 1382 connected to a power supply (not shown) through a wire 1384. A glass flit or adhesive (e.g, silicone glue) 1404 is used to attach the CCFL 1202*j* to the surfaces of the matching holes in the bottom support plates 1402. Thus, the electrodes 1382 at the four ends 1202*j*' are all outside the chamber enclosed by container 1204*c*, so that the heat generated at such electrodes will dissipate in the environment without causing the temperature of the CCFLs in the enclosed chamber to rise above the desired operating temperature range.

As described above in reference to FIGS. 8(*a*), 8(*b*) through FIGS. 11(*a*), 11(*b*), while a sustaining voltage may be applied to the CCFL for its operation in the generation of light after the CCFLs have been triggered into operation, a trigger voltage higher than the sustaining voltage should be applied to trigger the CCFL devices.

Figure 22:
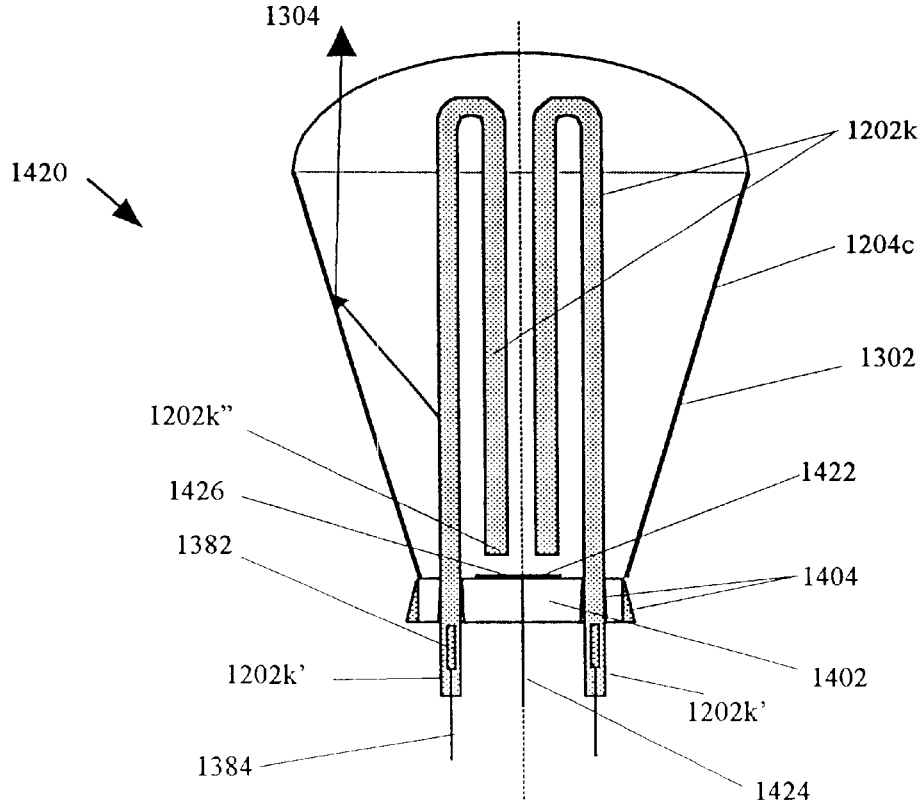

If multiple CCFLs are employed in the same discharge device, where a pair of electrodes is provided for each CCFL, the number of electrodes and the wires connected thereto may cause the device to be cumbersome to make and handle. For this reason, it may be desirable to employ a common electrode for two or more CCFLs, to reduce the number of electrodes and the corresponding number of connecting wires to the electrodes, thereby simplifying the construction of the discharge device. In FIG. 22, each of the two CCFLs 1202*k* has two ends, with end 1202*k*' extending through the bottom support plate 1402 to a position outside the enclosed chamber in container 1244*c*, and another end 1202*k*" which remains inside the chamber. While a separate electrode 1382 is employed at the end 1202*k*' of each of the two CCFLs, a common electrode 1422 situated on top of the bottom support plate 1402 is used for applying voltages to the two ends 1202*k*" of the two CCFLs. The common electrode 1422 is connected to a power supply (not shown) for supplying power to the device 1420 by means of wire 1424. While it may be advantageous for the electrode 1422 to be in contact with ends 1202*k*" of the two CCFLs, it may also be spaced from the two ends by a small gap 1426 without significantly affecting the operation of the discharge device. By permitting such a small gap, the construction of device 1420 is much simplified since electrode 1422 and ends 1202*k*" do not need to be very accurately positioned relative to one another. As in the embodiment of FIG. 21, at least some of the electrodes 1382 of device 1420 are outside the sealed or enclosed chamber in container 1204*c* so that heat generated by these electrodes readily dissipate in the environment.

Figure 23:
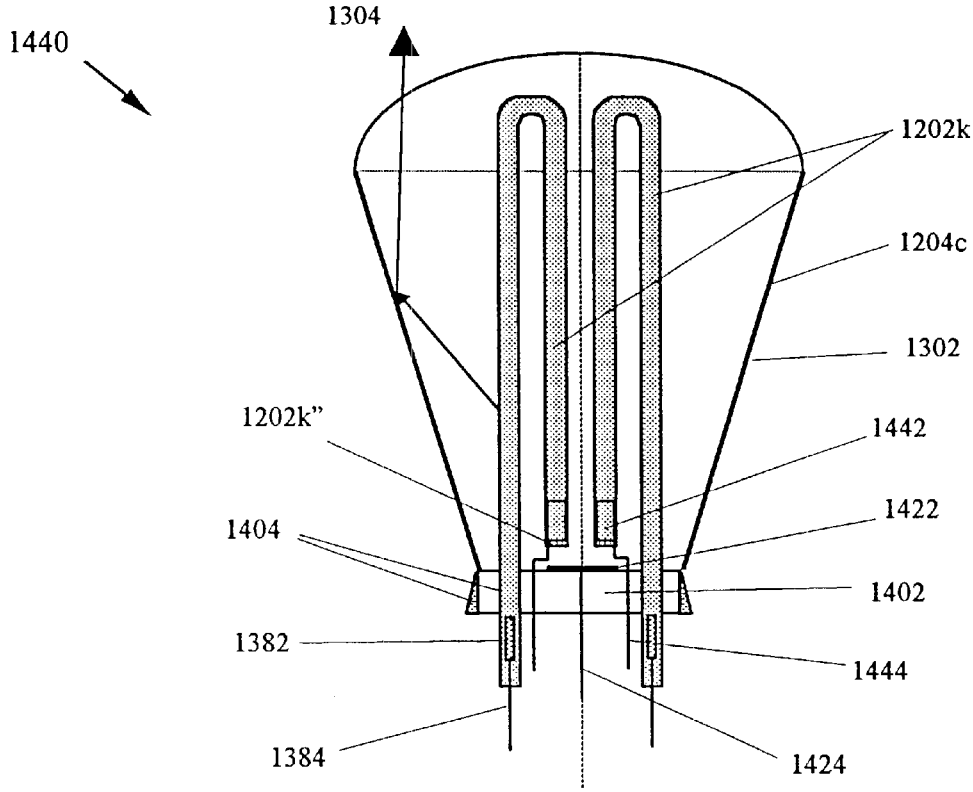
FIGS. 23, 24 are schematic views of cold cathode gas discharge illumination devices with electrodes outside the chambers that enclose the CCFLs to facilitate heat dissipation. Trigger electrodes are added to facilitate the electrical triggering that controls the starting of the CCFLs.

As described above, while CCFL's may be operated at a sustaining voltage, a voltage higher than the sustaining voltage known as the starting voltage, needs to be applied to the CCFL in order to initiate gas discharge for generating light, after which the gas discharged may be maintained by a lower sustaining voltage. In the electrical configurations of FIGS. 21, 22, both the higher start voltage and the lower sustaining voltage would need to be applied across the same pair of electrodes. Thus in FIG. 21, the voltages need to be applied across electrodes 1384 at the two ends of each CCFL 1202*j*. In FIG. 22, the voltages need to be applied across the common electrode 1422 and the other two electrodes 1382 at the ends 1202*k*' of the two CCFL's. To facilitate the application of start and sustaining voltages to the CCFL's, one or more trigger electrodes may be added as shown in FIG. 23. Thus, the discharge device 1440 is substantially the same as device 1420 of FIG. 22, except that two trigger electrodes 1442 have been added at the ends 1202*k*" of the two CCFL's 1202*k*.

When the discharge device 1440 is in the off state without generating any light, to initiate gas discharge, a start voltage is applied across trigger electrodes 1442 and 1382 at the two CCFL's, to initiate gas discharge. After gas discharge has been initiated, a sustaining voltage is then applied across the common electrode 1422 and electrodes 1382 of the two CCFL's to sustain the gas discharge and to generate light emission. After the gas discharge has been initiated and maintained by the sustaining voltage, the start voltage across electrodes 1442 and 1382 may be turned off. Electrodes 1442 are connected to a power supply (not shown) for supplying the start voltage by means of wires 1444.

Figure 24:
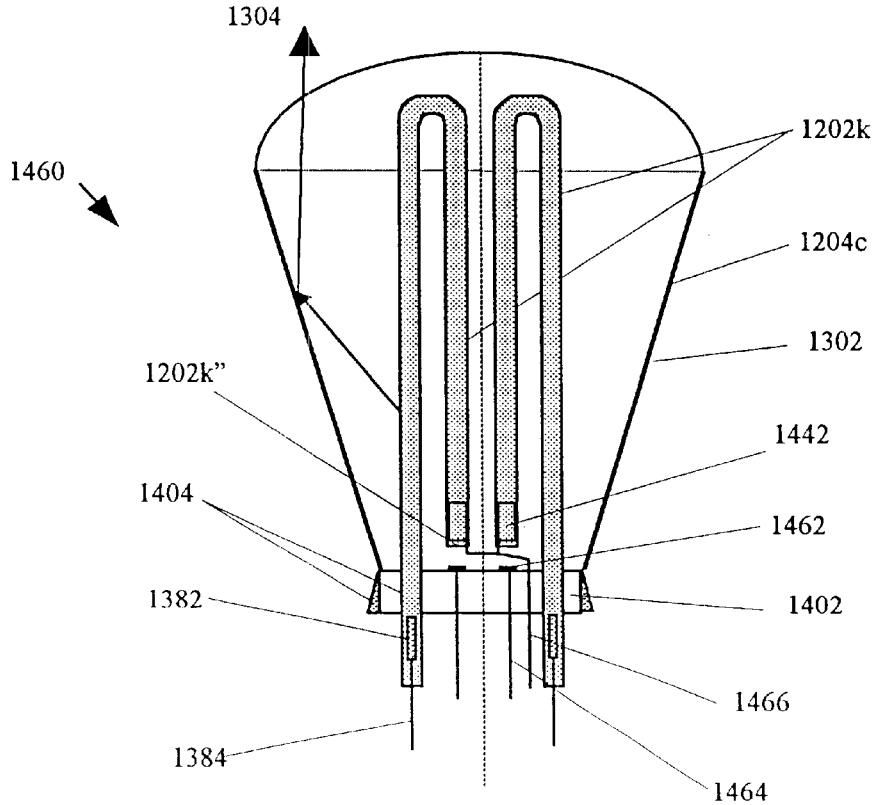

FIG. 24 illustrates a discharge device 1460 that is substantially similar to device 1440 of FIG. 23, except that the two electrodes 1442 at the ends 1202*k*" of the two CCFL's are connected to a power supply (not shown) by a common wire 1466. Instead of using a single common electrode 1422, two separate electrodes 1462 are used, one for each of the two CCFL's, for applying a sustaining voltage across the CCFL between the electrodes 1442 and 1382. Each of the two electrodes 1462 is connected to a power supply (not shown) by means of wire 1464.

Figure 25:
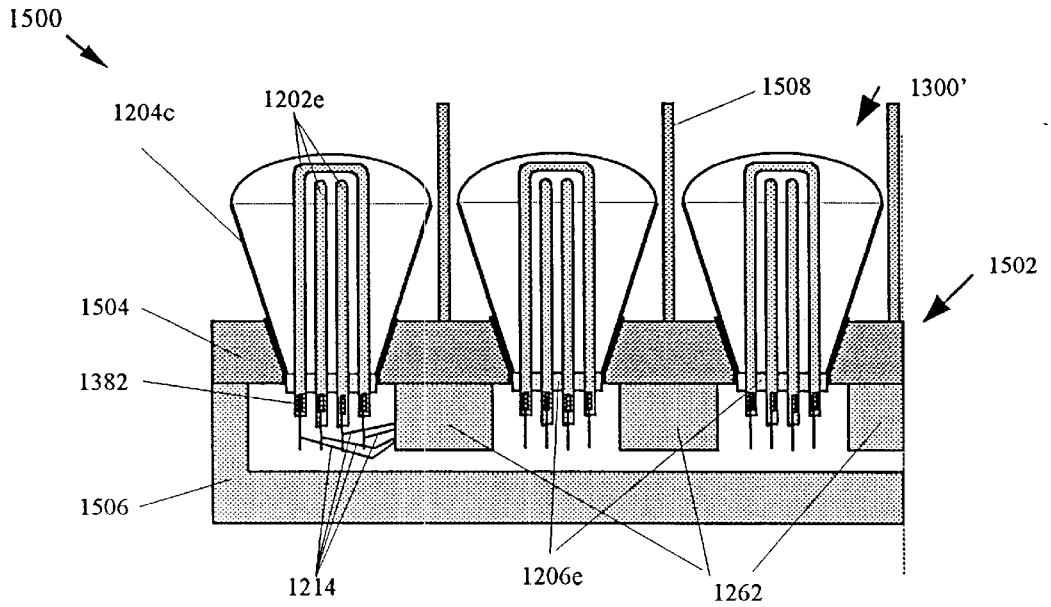
FIG. 25 is a cross-sectional view of a portion of a display employing a two-dimensional array of CCFL gas discharge devices, each device having a container for housing a CCFL.
Figure 26:
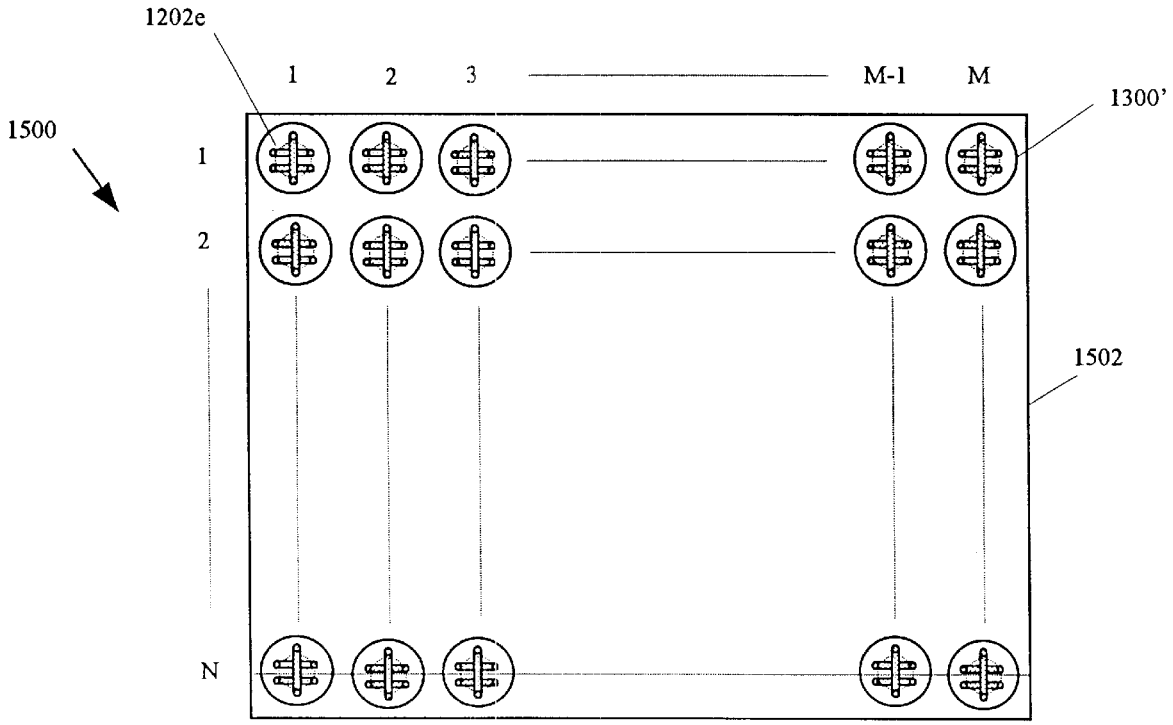
FIG. 26 is a top view of the device of FIG. 25.

A number of the CCFL's of the type described above may be arranged in an array to form a display device for displaying still or moving characters and images, such as for television, motion picture or computer displays. FIG. 25 is a cross-section view of a portion of a display device 1500 showing only three discharge devices 1300' using CCFL's. The three discharge devices 1300' resemble discharge device 1300 of FIG. 16, except that, devices 1300' are not stand-alone devices and have no lamp holders as does device 1300. The bottom portions of the containers 1204*c* of the three devices 1300' are attached to a module housing 1502 for holding the plurality of discharge devices 1300', so that the devices form a two dimensional array as shown in FIG. 26, suitable for displaying still or moving images and characters, such as in television, motion picture or in computer applications. Glass frit or another suitable adhesive may be used for attaching the containers 1204*c* to housing 1502.

Module housing 1502 may comprise a top plate 1504 having matching holes therein for the bottom portions of containers 1204*c* of devices 1300'. After the devices have been inserted and attached to the plate 1504, the electrodes at the ends of the CCFL's of the devices 1300' are then connected to drivers 1262 by means of wires 1214 for individually controlling and powering each of the three CCFL's within each of the devices 1300'. Preferably, the three CCFL's in each of the devices 1300' are such that one would display red light, another one blue light and the remaining one green light. After the devices 1300' have been connected to the drivers 1262, the top plate 1504 is attached to a shallow receptacle 1506 to form the module housing 1502. Preferably, a separation wall or shade 1508 is employed between each pair of adjacent discharge devices 1300' to enhance contrast.

FIG. 26 is a top view of device 1500 of FIG. 25, but where the separation walls 1508 have been omitted to simplify the figure. As shown in FIG. 26, display 1500 includes a N by M array of discharge devices 1300', where M and N are positive integers. As noted above, each discharge device 1300' includes three CCFL's for emitting red, green and blue light. The three CCFL's may be controlled by means of driver 1262 to emit only single color light, or to emit two or three different color light sequentially, or simultaneously in any combination. The addressing and control of the N by M array may be performed by using any one of the schemes in FIGS. 8(*a*), 8(*b*), . . . , FIGS. 11(*a*), 11(*b*).

Figure 27:
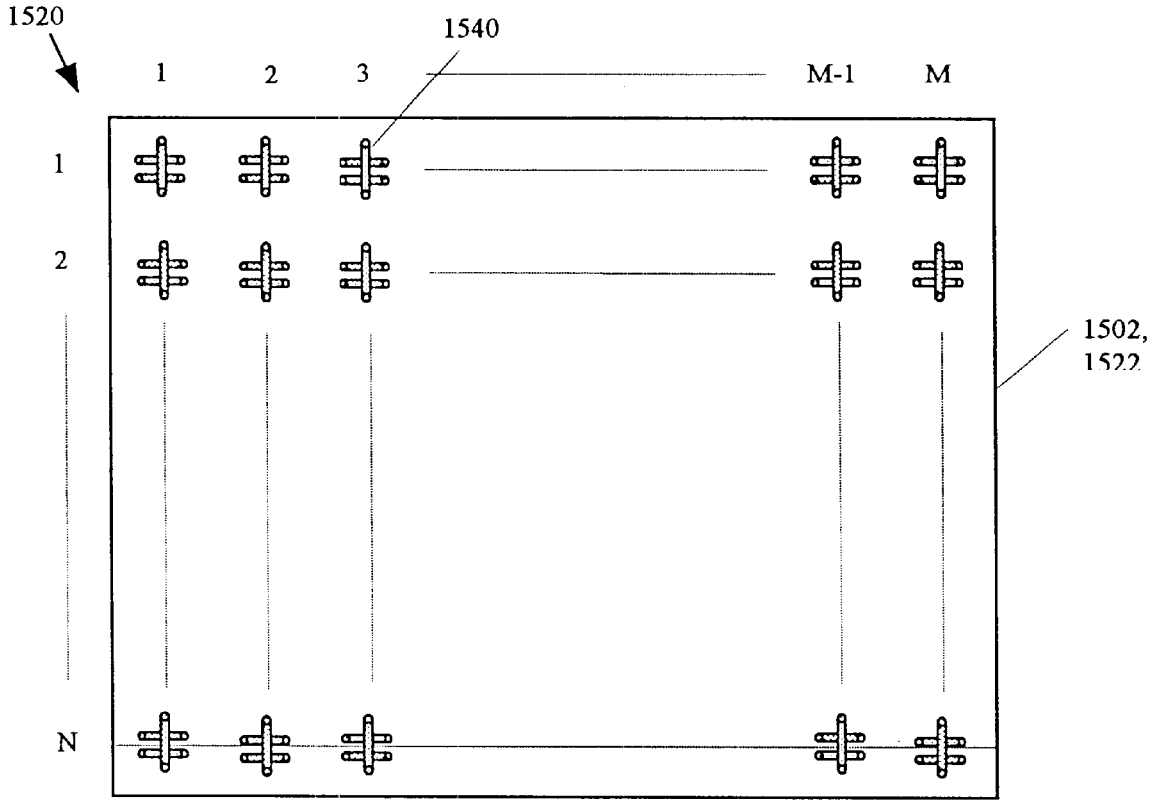
FIG. 27 is a top view of a display device similar to that in FIG. 26, except that the individual CCFL gas discharge devices do not have individual containers, but these individual containers have been replaced by a large container enclosing and housing all of the CCFLs.

As shown in FIGS. 25 and 26, each discharge device 1300' includes its own container 1204*c* for maintaining the temperatures of the three CCFL's to be within the desired operating temperature range of 30–75° C. Instead of employing individual containers for each discharge device, it may be possible to remove the containers 1204*c* for the individual discharge devices and attach directly the base plates 1206*e* to the top plate 1504. All of the CCFL's in the N by M array are then enclosed within a top receptacle 1522 that matches the bottom receptacle 1506 to enclose all of the CCFL's in the device and to prevent heat loss from and effect of ambient temperature on the CCFL's, so that the temperatures of the CCFL's are maintained within the desirable operating range of 30–75° C. Such modified display 1520 is shown in FIG. 27. As before, the chamber enclosed by top receptacle 1522 may be evacuated or filled with nitrogen or an inert gas. Thus, each group of three CCFL's in displays 1540, emitting red, green and blue light form a pixel, so that the display device 1520 each would include N by M pixels.

The CCFL discharge device of this invention may also be used for displaying traffic information, such as in traffic lights that are installed at street intersections, tunnels, freeways, railroad crossings or wherever the display of traffic information is desirable. This is illustrated in FIGS. 28–40.

Figure 28:
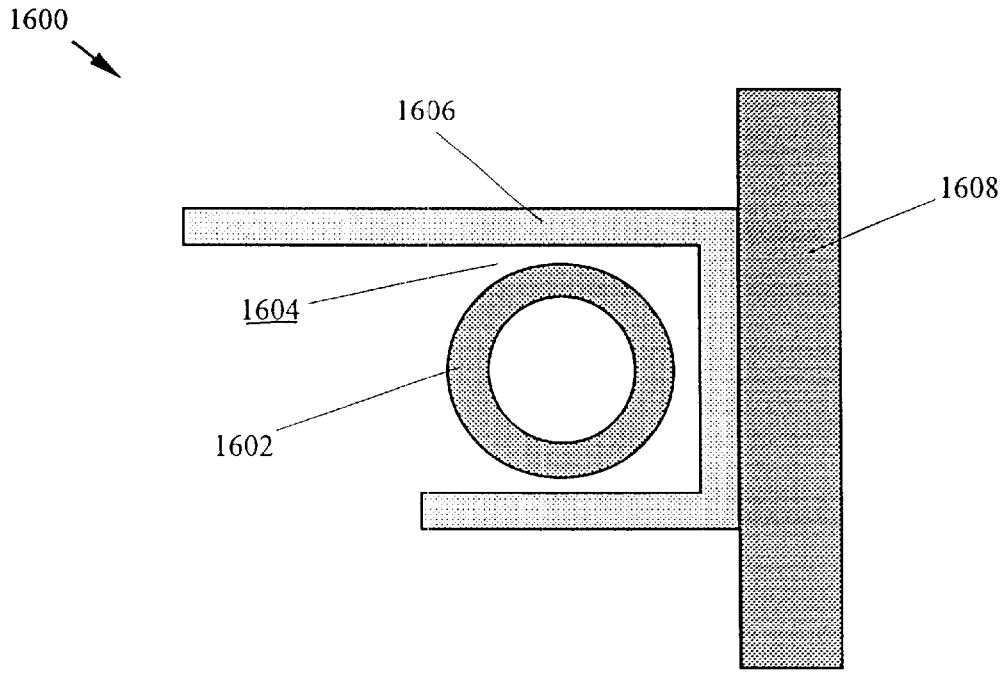
FIGS. 28 and 29 are schematic views of traffic information display devices employing CCFLs to illustrate the invention.

As shown in FIG. 28, a traffic information display device 1600 includes a CCFL 1602 within the chamber 1604 partially enclosed by receptacle 1606, where the inner surface of the receptacle is light reflective. Receptacle 1606 is attached to a substrate 1608 suitable for attachment to a support structure, such as a pole at a street intersection.

Figure 29:
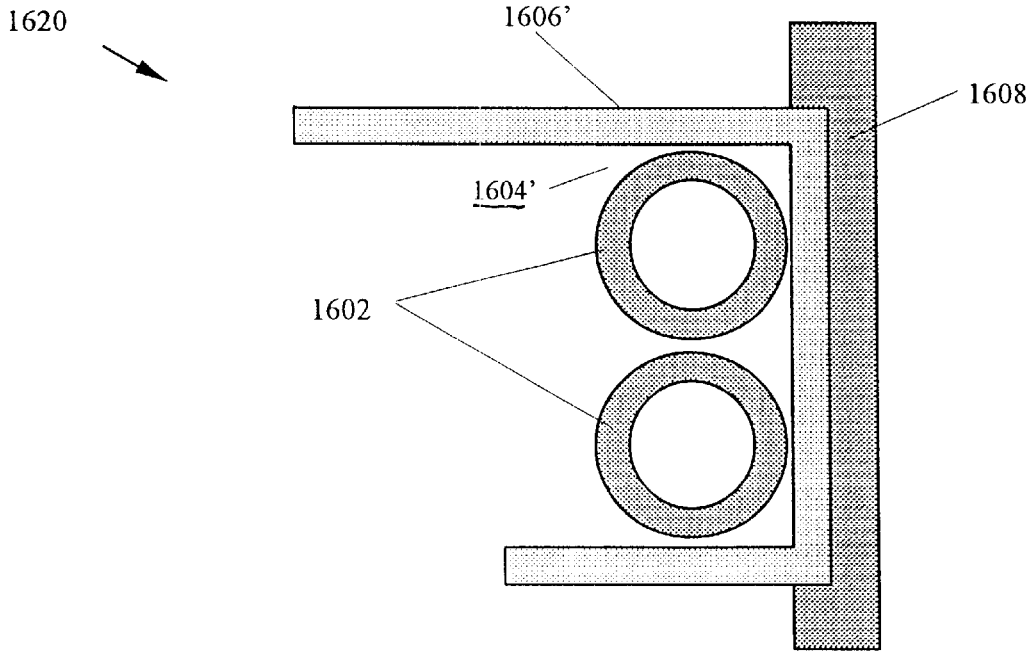

The traffic information display device 1620 of FIG. 29 is similar to device 1600 of FIG. 28, except that receptacle 1606' is larger and enclose two CCFL's 1602 rather than one within a larger chamber 1604'.

Figure 30:
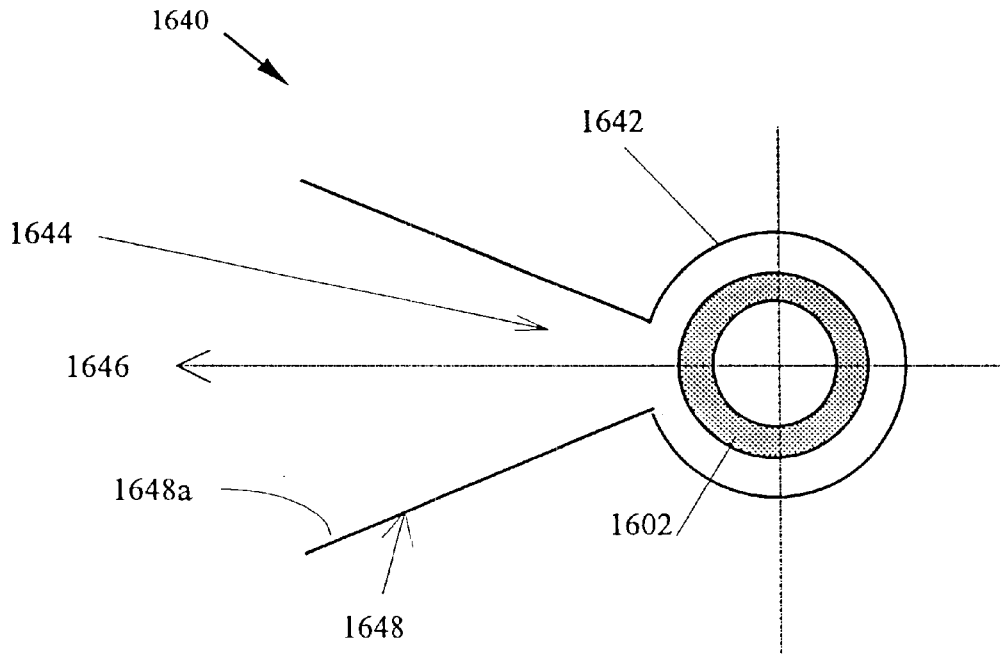
FIGS. 30–35 are cross-sectional views of traffic information display devices employing CCFLs.

For displaying traffic information in many situations, such as at street intersections, the information would need to be displayed only to within a certain large viewing angle from a viewing direction. For this reason, it is preferable to reflect the light emitted by a CCFL towards directions other than those within the viewing angle so that such light would be directed towards the direction for viewing. For this purpose, the reflective chambers may each be constructed with an output window towards the viewing direction as shown in FIG. 30. Thus, the receptacle 1642 has a light reflective surface on its inner wall and an output window 1644 facing a viewing direction 1646. In order to further direct light emitted by the CCFL 1602 towards the viewing direction, reflective surface(s) 1648 may be connected to receptacle 1642 at the window, where the surface(s) has a light reflective inner surface 1648*a*.

Figure 31:
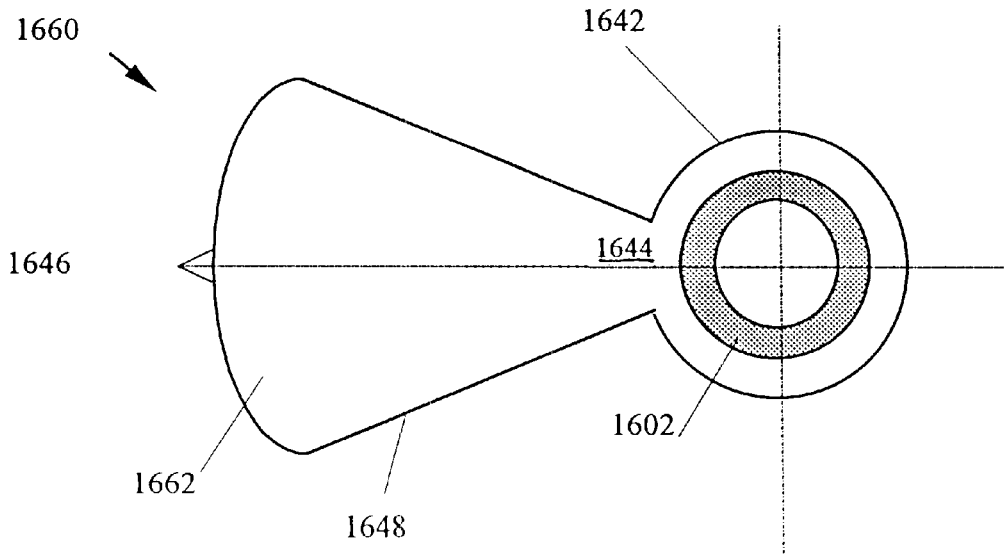

The traffic information display device 1660 of FIG. 31, is substantially the same as device 1640 of FIG. 30, except that in addition, a lens 1662 is employed to further collect and focus the light emitted by the CCFL and reflected by surface(s) 1648 towards the viewing direction 1646. Thus, the lens 1662 and the surface(s) 1648 together focus light emitted through the window 1644 towards the viewing direction or within a certain viewing angle from the viewing direction. The lens and the surface(s) thus form a condensing apparatus.

Figure 32:
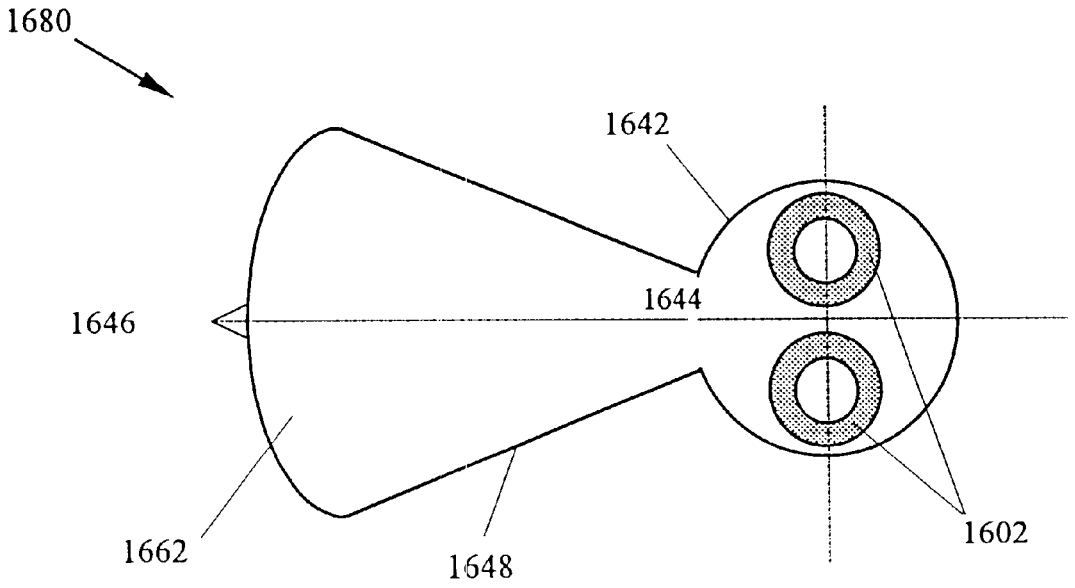

The traffic information display device 1680 of FIG. 32 is substantially the same as device 1660 of FIG. 31, except that device 1680 includes two CCFL's instead of one.

Figure 33:
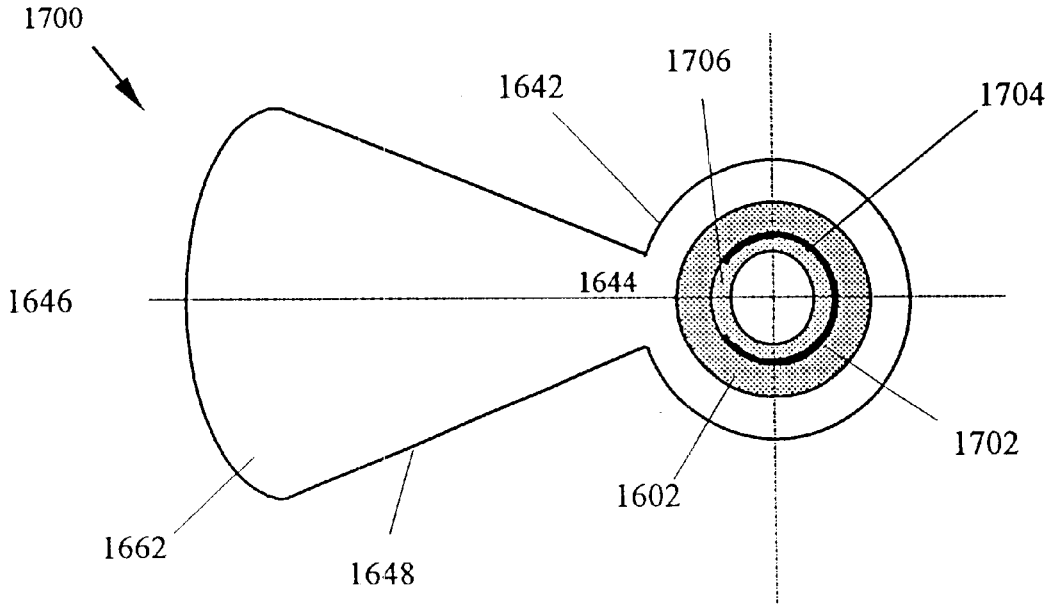

FIG. 33 is a schematic view of a traffic information display device 1700 substantially the same as device 1660 of FIG. 31, except that device 1700 further includes a layer of phosphor 1702 within the cylindrical CCFL 1602 for generating light when ultraviolet light from the CCFL impinges upon the phosphor layer. In addition, device 1700 also includes another light reflective layer 1704 that is between the phosphor layer and the CCFL for reflecting light through another window 1706 towards the viewing direction 1646. Reflective layer 1704 does not form a complete cylinder, but has a window 1706 therein that is aligned with window 1644 of receptacle 1642 and faces the viewing direction 1646.

Figure 34:
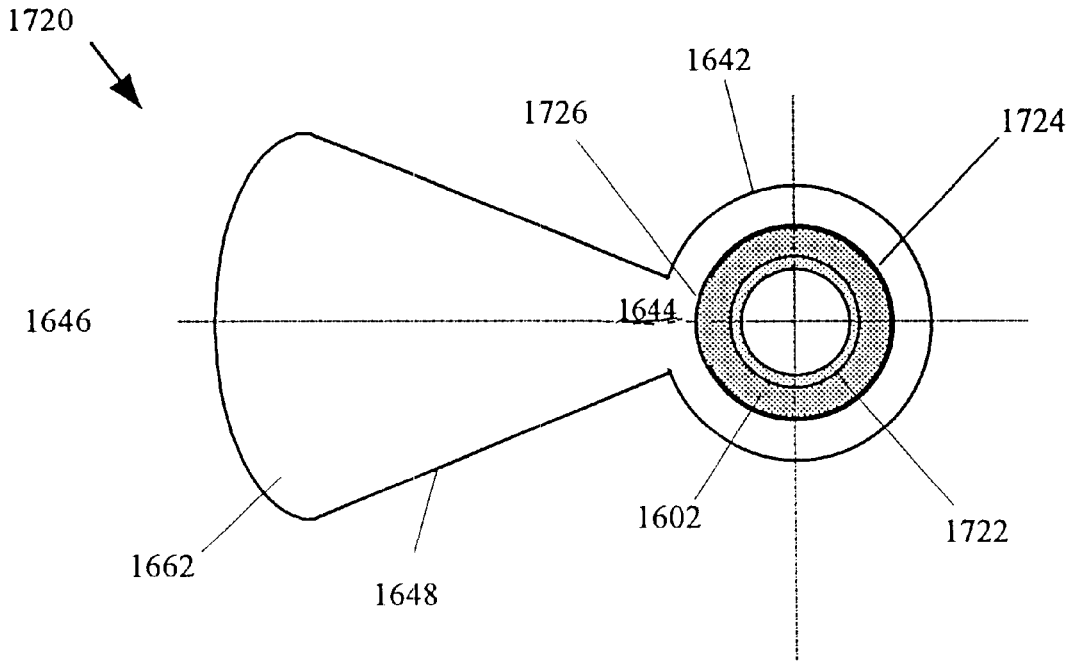

Device 1720 of FIG. 34 is substantially the same as device 1660 of FIG. 31, except that device 1720 includes an additional phosphor layer 1722 that is on the inside surface of the substantially cylindrical CCFL 1602, a light reflective layer 1724 on the outside surface of the CCFL, where the reflective layer does not completely surround the CCFL, but leaves a window 1726 that is aligned with window 1644 of receptacle 1642 and faces the viewing direction 1646. Thus, ultraviolet light emitted by the CCFL causes the phosphor layer 1722 to generate light and light emitted by the phosphor layer and the CCFL are reflected by the inner surface of light reflective layer 1724 through windows 1726 and 1644 towards the viewing direction 1646.

Figure 35:
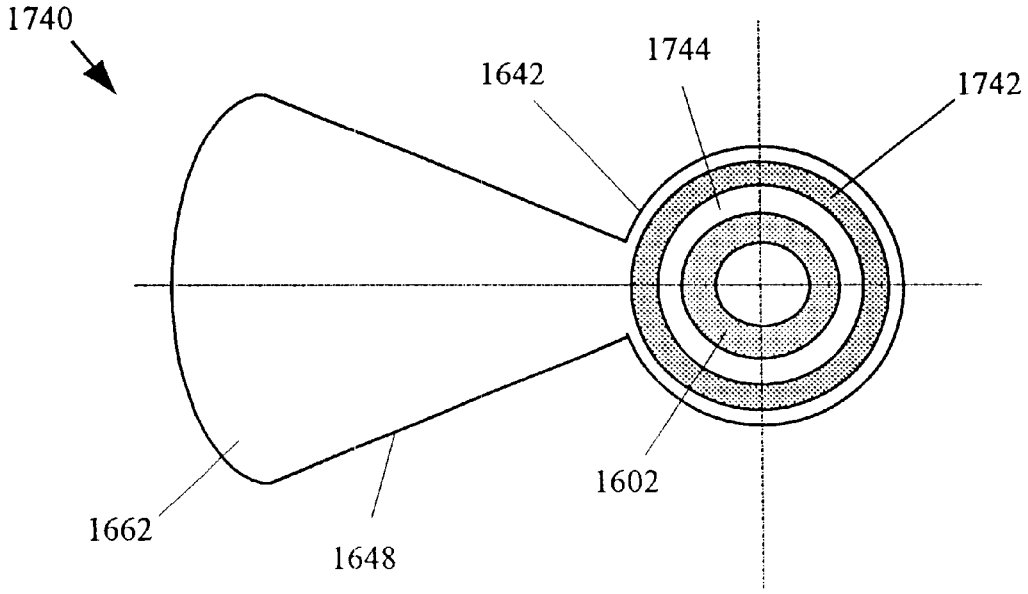

Traffic information display device 1740 of FIG. 35 is substantially the same as device 1660 of FIG. 31, except that device 1740 includes an additional outer shell 1742 in between the CCFL 1602 and the receptacle 1642. Shell 1742 encloses therein a chamber 1744. In reference to FIG. 35, the outer shell 1742 defines therein chamber 1744 which may be evacuated or filled with nitrogen or inert gas or other types of suitable gases to reduce heat loss; this increases the luminous efficiency and facilitates easy starting of the CCFL.

Figure 36:
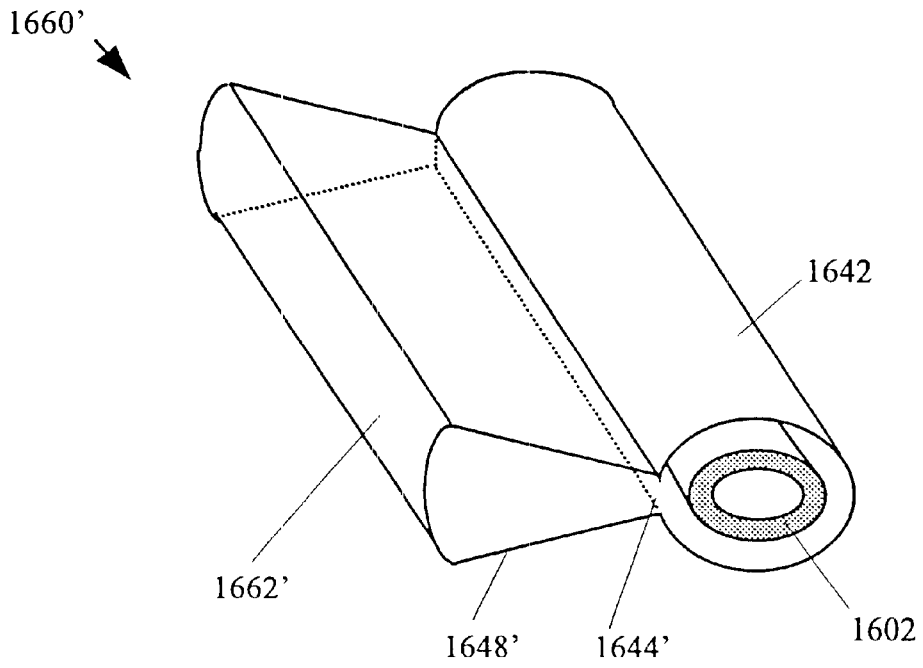
FIG. 36 is a perspective view of one embodiment of the device of FIG. 31.
Figure 37:
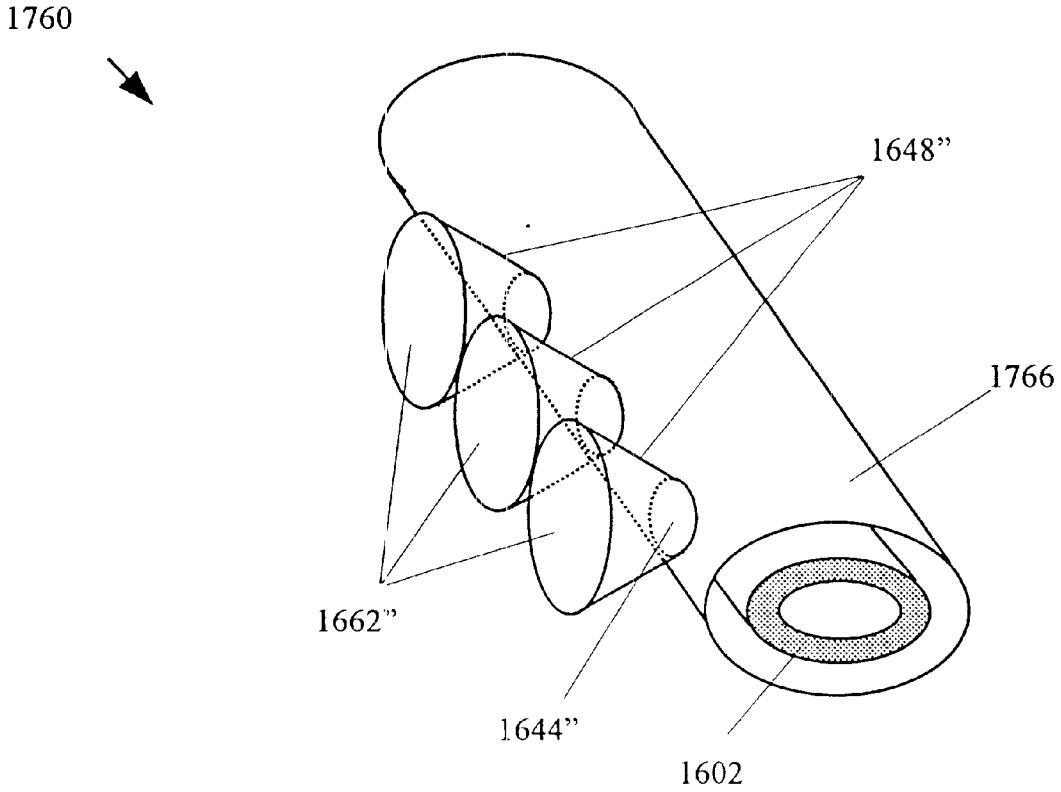
FIGS. 37 and 38 are perspective views of two different embodiments of the device of FIG. 31, employing three separate lenses for collecting and focusing light from three different windows.

FIG. 36 is a perspective view of an embodiment 1660' of device 1660 of FIG. 31, where lens 1662' is cylindrical, and the reflective surface(s) comprises two flat surfaces 1648'. The traffic information display device 1760 of FIG. 37 is another embodiment of device 1660 of FIG. 31 and is similar to device 1660', except that three spherical, paraboloidal or ellipsoidal lenses 1662" are employed, rather than a cylindrical lens 1662'. The reflective surfaces 1648" adjacent to lenses 1662" are conical in shape, rather than being flat surfaces 1648' in FIG. 36. The windows 1644" are circular in shape to match the conical reflective surfaces 1648", rather than in the shape of an elongated slit 1644' of FIG. 36. Where it is desirable to display different color light through the three lenses 1762, three different CCFL's for emitting red, green and yellow light may be employed instead of a single CCFL 1602.

Figure 38:
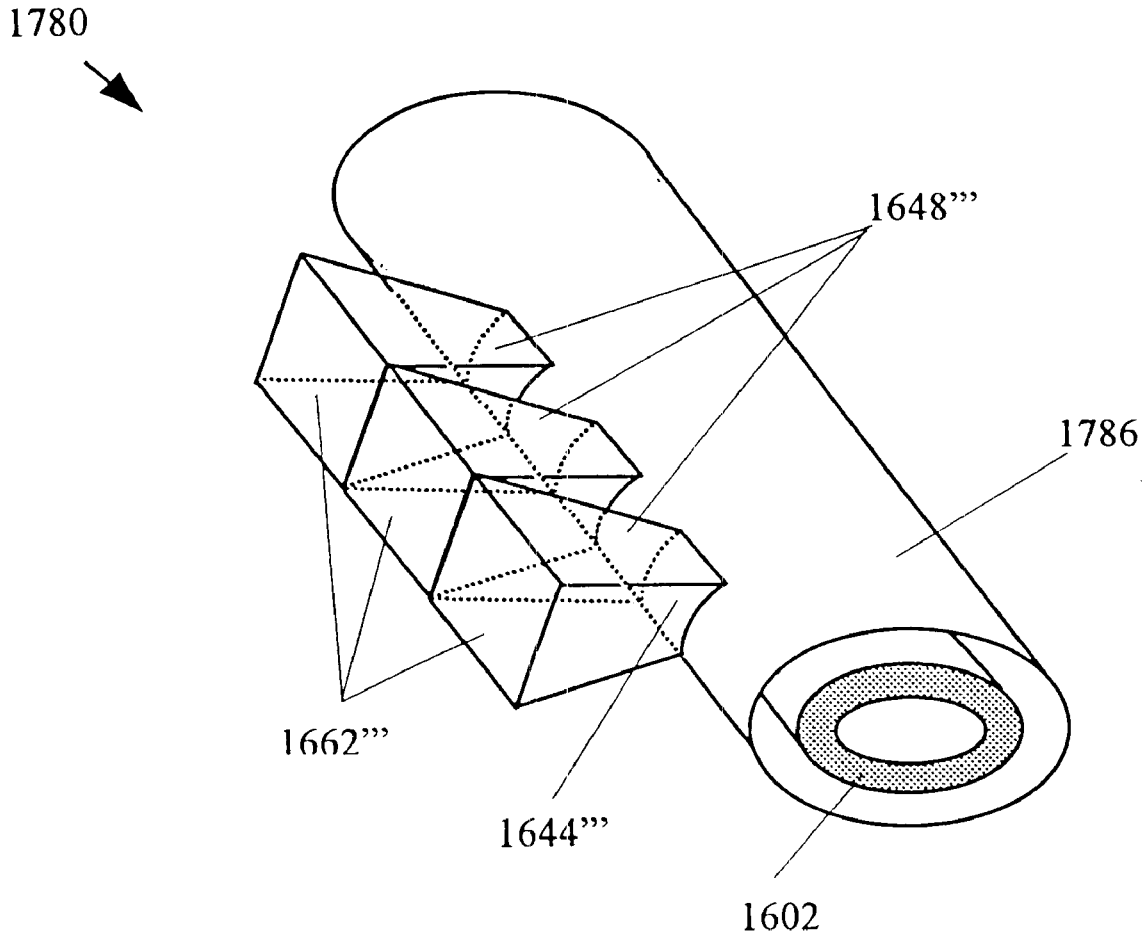

The traffic information display device 1780 of FIG. 38 is substantially the same as device 1760 of FIG. 37, except that the lenses 1662"' are square or rectangular in shape rather than being round, and that the surfaces 1648"' form pyramids and have square or rectangular cross sections rather than circular or elliptical cross sections as in device 1760 and windows 1644"' are square or rectangular in shape rather than elliptical or circular in shape.

Figure 39:
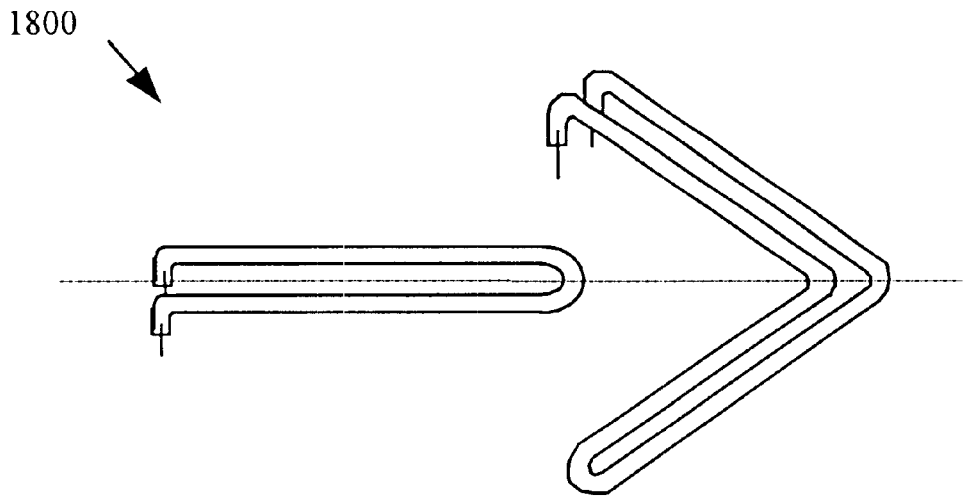
FIGS. 39(*a*), 39(*b*), 39(*c*) and 39(*d*) are schematic views of four different arrangements of CCFLs for displaying four different traffic signals.
Figure 39:
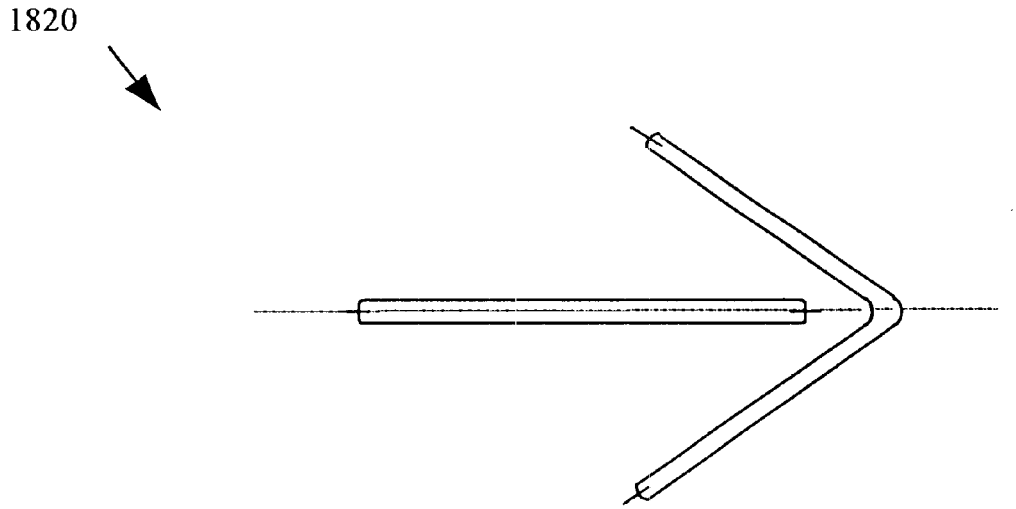
Figure 39:
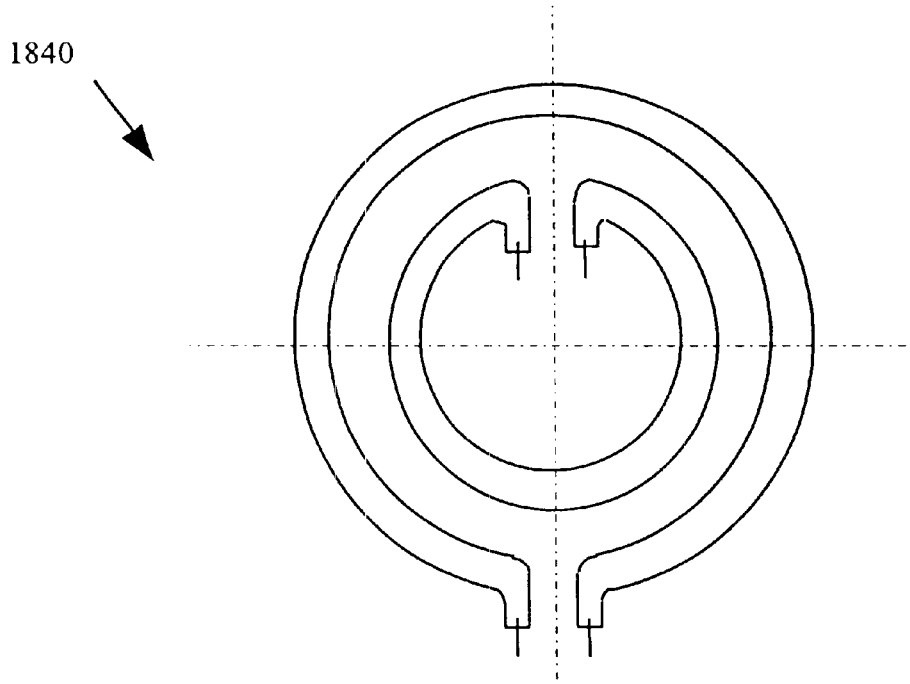
Figure 39:
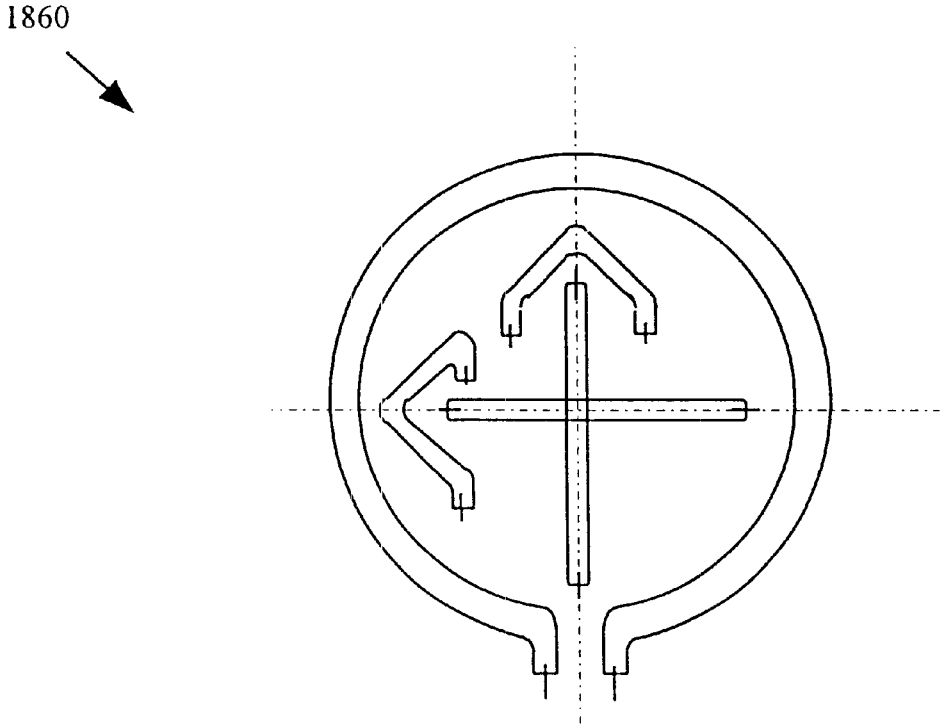

FIGS. 39(*a*), 39(*b*), 39(*c*) and 39(*d*) illustrate four different shapes of displays, each display employing two or more CCFL's to illustrate another embodiment of the invention. Thus, the display device 1800 includes two CCFL's 1802 for displaying an arrow shaped traffic signal. The display device 1820 of FIG. 39(*b*) is another embodiment for displaying an arrow shaped traffic signal. Device 1840 of FIG. 39(*c*) is used for displaying a circular shaped traffic signal and the device 1860 including three CCFL's is for displaying two arrow shaped signals pointing in different directions; the two signals would be displayed at different times to indicate the proper direction for traffic at such times.

Figure 40:
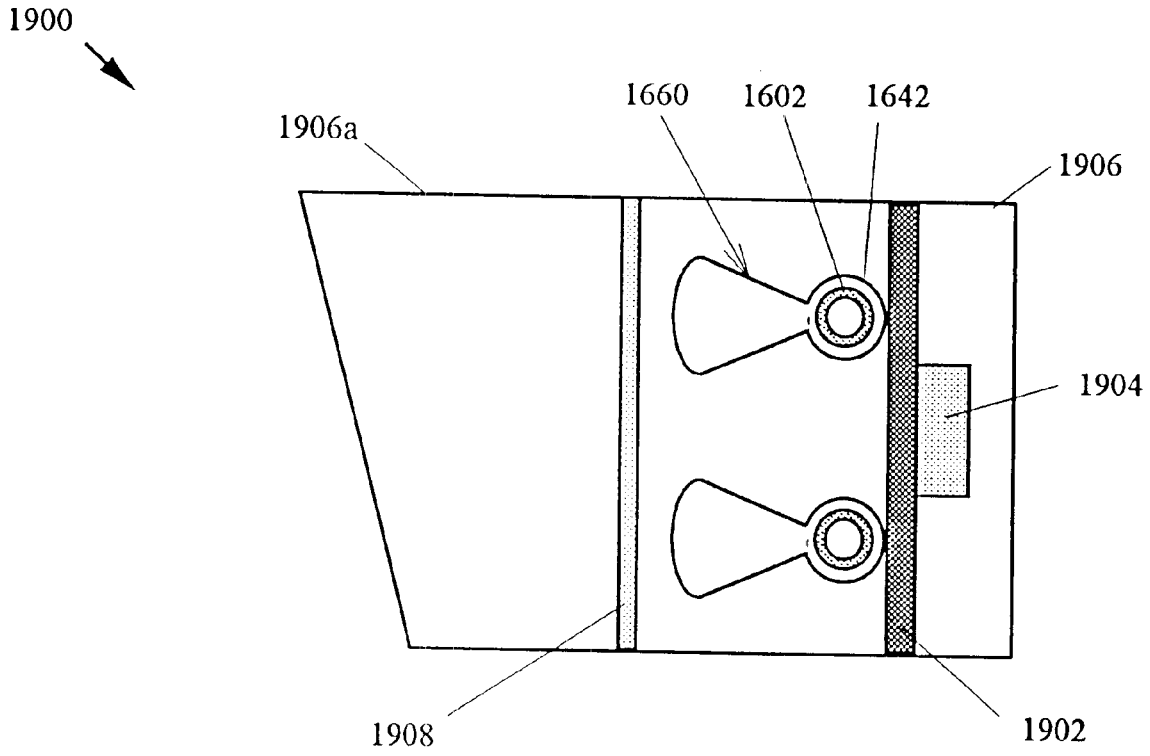
FIG. 40 is a cross-sectional view of a traffic information display device to illustrate another embodiment of the invention.

FIG. 40 is a schematic view of a traffic information display device including two devices 1660 as shown in FIGS. 31; although other devices described above, such as devices in FIGS. 32–38 may also be used instead. The two devices 1660 are supported on a substrate 1902 on which is also mounted a driver 1904 for supplying power to the two devices 1660. The substrate 1902 is mounted in a container 1906 that has a top extended wall 1906(*a*) that serves as a shade for shielding the devices 1660 from direct sunlight or other ambient light. A filter 1908 may be installed for improving the color purity and contrast of the light emitted by the devices 1660.

Aside from the shapes of combination of CCFL's for displaying traffic signals in FIGS. 39(*a*)–39(*d*), the combination of CCFL's can be arranged to form other shapes as well, such as straight line, square, (+), (X), (T), or a shape that is a combination of the above. The reflective layer for reflecting light referred to above that is present on receptacles 1606, 1606', the inner wall of receptacle 1642, surface 1648*a*, layers 1704, 1724, as well as other reflective layers or surfaces described in reference to other figures of this application, the reflective layer may comprise high reflection coefficient powder that includes $T_{a2}O_3$, MgO, $Al_2O_3$, Ag or an alloy, or a thin film that includes Ag, Al or an alloy. Where the CCFL includes a glass tube, the high reflective layer may be deposited on an inside or outside surface of the glass tube to form a part of the lens to further increase light utilization factor of light generated by the lamp. For certain applications, a CCFL may include a colored glass tube, to improve the color characteristics of light emitted from the lamp and to absorb the incident ambient light, thereby increasing the contrast of the display.

Advantageously, a thermal insulation layer similar to heat preservation layer 113 of FIG. 1(*a*) may be employed on the outside surface of the receptacle 1606, 1606', 1642, 1766 and 1786. This may render it easier for the CCFL to start gas discharge at a low temperature environment. Wile receptacles 1606, 1606', 1642 are shown as cylindrical in shape, these receptacles having reflective inner surfaces may also be spherical, ellipsoidal, cubical or paraboloidal in shape.

The substrates 1608 of FIGS. 28, 29 and substrate 1902 of FIG. 40 are preferably substrates having high absorption coefficient surfaces to absorb incident ambient light. These substrates may comprise a rough surface black plate or a multi-holed black plate. The light reflective surface(s) 1648*a* may comprise a mirrored surface or a diffusive reflective surface. The cones 1648" of FIG. 37 may have a circular or elliptical shape and lenses 1662" may have a spherical, ellipsoidal or flat shape. The surfaces or cones 1648', 1648", 1648"' and lenses 1662', 1662", 1662"' may comprise glass, plastic or air.

In employing a light reflective surface in the description above, a mirrored surface, or a diffusive reflective surface may be used, where the diffusive reflective surface is made from a high reflection coefficient powder. Alternatively, the reflection of light from the CCFL towards the output window may be accomplished by means of total internal reflection. For such purpose, instead of using a mirrored or diffusive reflective surface, one would employ an interface between two optical media having different indices of refraction so that light from the CCEL will experience total internal reflections at the interface until such light is directed towards the output window.

To form the traffic signals shown in FIGS. 39(*a*)–39(*d*), a combination of CCFLs are used. These CCFLs may emit monochromatic, multi-colored or red, green and yellow light. The reflective chamber 1642 is a sealed or almost sealed chamber in which there is substantially no convection flow from outside the chamber. The receptacle 1642 of the various figures described above is preferably sealed so that the discharge device for displaying traffic information is waterproof and will not be affected by moisture or rain.

While the invention has been described above by reference to various embodiments, it will be understood that different changes and modifications may be made without departing from the scope of the invention which is to be defined only by the appended claims and their equivalents.

What is claimed is:

1. A cold cathode gas discharge illumination apparatus, comprising:

at least one cold cathode fluorescent lamp;

a light transmitting container housing said at least one lamp; and a gas medium in the container so as to increase the luminous efficiency, and to reduce heat loss from and the effect of the ambient temperature on the at least one fluorescent lamp.

* * * * *